US009167649B2

(12) United States Patent
Kamoi et al.

(10) Patent No.: US 9,167,649 B2
(45) Date of Patent: Oct. 20, 2015

(54) LIGHTING DEVICE AND LUMINAIRE

(71) Applicant: Panasonic Corporation, Osaka (JP)

(72) Inventors: Takeshi Kamoi, Kyoto (JP); Daisuke Yamahara, Osaka (JP); Keisuke Seki, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/444,017

(22) Filed: Jul. 28, 2014

(65) Prior Publication Data

US 2015/0035447 A1 Feb. 5, 2015

(30) Foreign Application Priority Data

Aug. 2, 2013 (JP) ..... 2013-161760
Aug. 2, 2013 (JP) ..... 2013-161831

(51) Int. Cl.
*H05B 37/02* (2006.01)
*H05B 33/08* (2006.01)

(52) U.S. Cl.
CPC ..... *H05B 33/0818* (2013.01)

(58) Field of Classification Search
USPC ..... 315/185 R, 186, 224–226, 291, 294, 315/297, 299, 300, 307, 308, 360
See application file for complete search history.

(56) References Cited

U.S. PATENT DOCUMENTS 7,919,936 B2 4/2011 Liu et al.
8,148,919 B2 4/2012 Liu et al.
8,237,379 B2 8/2012 Liu
8,253,352 B2 8/2012 Liu
8,593,067 B2 11/2013 Iwai et al.
2008/0224625 A1* 9/2008 Greenfeld ..... 315/201
2010/0026208 A1* 2/2010 Shteynberg et al. ..... 315/297
2010/0033109 A1 2/2010 Liu et al.
2011/0181198 A1 7/2011 Iwai et al.
2011/0248648 A1 10/2011 Liu
2011/0254462 A1* 10/2011 Ruan et al. ..... 315/291
2011/0316447 A1 12/2011 Liu
2012/0032613 A1 2/2012 Liu et al.
2012/0187847 A1* 7/2012 Hamamoto et al. ..... 315/125
2012/0262087 A1 10/2012 Watanabe et al.
2014/0117865 A1* 5/2014 Deng et al. ..... 315/200 R

FOREIGN PATENT DOCUMENTS

JP 2010-040509 2/2010
JP 2011-155101 8/2011
JP 2011-210659 10/2011
JP 2011-223800 11/2011
JP 2012-043657 3/2012
JP 2012-109141 6/2012

(Continued)

*Primary Examiner* — Tung X Le
(74) *Attorney, Agent, or Firm* — Renner, Otto, Boisselle & Sklar, LLP

(57) ABSTRACT

A lighting device includes a DC/DC converter (step-down chopper circuit) and a control circuit that includes a correction circuit. The correction circuit corrects the timing at which a switching element included in the DC/DC convertor is turned OFF based on a voltage value across a solid-state light-emitting element (LED unit). The correction is made such that an average value of a current flowing through an inductor included in the DC/DC converter is within a predetermined range regardless of a voltage value across the solid-state light-emitting element.

13 Claims, 22 Drawing Sheets

(56) References Cited

FOREIGN PATENT DOCUMENTS

| | | |
|---|---|---|
| JP | 2012-175887 | 9/2012 |
| JP | 2012-221899 | 11/2012 |
| JP | 2012-222322 | 11/2012 |

* cited by examiner

LIGHTING DEVICE AND LUMINAIRE

CROSS REFERENCE TO RELATED APPLICATIONS

This application claims the benefit of priorities of Japanese Patent Application Number 2013-161760, filed Aug. 2, 2013, and Japanese Patent Application Number 2013-161831, filed Aug. 2, 2013, the entire content of which are hereby incorporated by reference.

TECHNICAL FIELD

The present disclosure relates to a lighting device that lights up a solid-state light-emitting element, such as a light-emitting diode (LED), and to a luminaire including the lighting device.

BACKGROUND ART

Solid-state light-emitting elements, such as LED elements, are expected to become light sources for various products due to their small size, high efficiency, and long life span.

The voltage-current characteristics of an LED element have a non-linear feature in which an electric current (hereinafter, simply referred to as current) starts flowing at a certain applied voltage or higher, and a forward voltage does not substantially change while a current near a rated current value is flowing. Hence, a light output of the LED element basically depends on a value of a current flowing through the LED element.

In illumination uses, an LED unit 1, illustrated in FIG. 1 and including a plurality of LED elements 2 connected in series-parallel, is used as a light source, so as to obtain a light output of a predetermined luminance.

As described above, the light output of the LED element depends on a value of a current flowing through the LED element. Hence, the current value corresponding to the light output of a predetermined luminance is set as a rated current value of the LED unit 1.

Accordingly, the lighting device that lights up the LED unit 1 is desirably controlled such that a constant current is supplied to the LED unit 1.

FIG. 2 is a circuit diagram of an example of a lighting device for an LED unit. FIG. 2 illustrates not only the lighting device, but also a DC power source E1 that supplies a DC power to the lighting device, and an LED unit 23 connected to the lighting device.

The lighting device includes a step-down chopper circuit 21 that is one type of a DC/DC converter, and a control circuit 22. The step-down chopper circuit 21 includes a switching element Q1, an inductor L1, a diode D1, an output capacitor C1, and the like.

The step-down chopper circuit 21 further includes a current detection circuit IS1 and a diode voltage detection circuit VS1. The current detection circuit IS1 detects a current value Isense1 flowing through the inductor L1. The diode voltage detection circuit VS1 detects a voltage value Vsense1 across the diode D1.

Examples of the DC power source E1 include a DC power source that includes a commercial AC power source and a full-wave rectifier circuit, and a DC power source that includes a commercial AC power source and a power factor improvement circuit.

Now, a brief description is given of an operation of the lighting device illustrated in FIG. 2.

When the switching element Q1 is turned ON in response to a command from the control circuit 22, a current flows through the LED unit 23 from the DC power source E1 via the switching element Q1, the inductor L1, and the output capacitor C1. The current flowing through the inductor L1 has a time rate of change of (Vin−Vout)/L that is determined by a voltage value Vin of the DC power source E1, a load voltage Vout applied to the LED unit 23, and an inductance value L of the inductor L1.

The switching element Q1 is turned OFF when the above current is detected by the current detection circuit IS1 and a detected value Isense1 reaches a target current value Iref.

When the switching element Q1 is turned OFF, energy stored in the inductor L1 is released with a current supplied while the switching element Q1 was ON.

While the energy stored in the inductor L1 is being released, the diode D1 is conducting. At this time, the diode has a forward voltage that has a very small value. When the diode D1 becomes non-conducting after the energy release, the voltage across the diode D1 rises to a value near the load voltage Vout.

The rise of the voltage across the diode D1 is detected through detection that a voltage value Vsense1 that is an output of the diode voltage detection circuit VS1 has exceeded a predetermined value Vref. When the rise of the voltage across the diode D1 is detected, the control circuit 22 determines that the release of the energy stored in the inductor L1 is finished, and turns ON the switching element Q1 again.

FIG. 3 is a circuit diagram illustrating an example of the control circuit 22 that operates as described above.

The control circuit 22 includes comparators 31 and 32, and an RS flip-flop.

The comparator 31 is an element that detects a current flowing through the inductor L1. The comparator 32 is a circuit that detects a voltage generated in the diode D1.

The RS flip-flop is a circuit that receives I_detect that is an output of the comparator 31 as a reset signal, and receives V_detect that is an output at a connection point 35 of the comparator 32 as a set signal. The RS flip-flop that outputs a signal to a connection point 36 is formed by NOR circuits 33 and 34 illustrated in FIG. 3.

FIG. 4 is a timing chart illustrating operations of respective elements in the lighting device described above.

In FIG. 4, currents flowing through the switching element Q1, the diode D1, and the inductor L1 are respectively represented by I_Q1, I_D1, and I_L1.

By use of the lighting device that operates as described above, energy is continuously supplied to the lighting device, and a stable DC current is supplied from the output capacitor C1 to the LED unit 23 serving as a load. In addition, in principle, an appropriate setting of a current peak value of the inductor L1 allows the LED unit 23 to be lit up with a rated current.

Moreover, there are conventional techniques for enhancing stabilization of a current flowing through an LED unit. Japanese Unexamined Patent Application Publication No. 2012-109141 (hereinafter, referred to as patent literature (PTL) 1) discloses a method below performed in a lighting device including a step-down chopper circuit. Specifically, the method is performed to keep a current flowing through an LED unit constant regardless of the variations in DC power source when an energy release of an inductor is detected by a voltage generated at a secondary winding of the inductor. In the technique disclosed in PTL 1, when a switching element is OFF, the voltage generated at the secondary winding of the inductor is used to keep a current flowing through an LED unit serving as a load constant even when a DC power source varies. In this way, the variations in current due to a power source voltage is reduced.

SUMMARY

As described below, however, stabilization of the light output of the LED unit for illumination uses is insufficient. As described above, in the LED unit for illumination uses, a plurality of LED elements are connected in series-parallel and used as one light source to secure sufficient luminance. Each LED element included in the LED unit is appropriately manufactured. However, there are variations in voltage (forward voltage) applied across each LED element when a constant current flows. Hence, the LED unit including such LED elements connected in series-parallel can have significant variations in forward voltage.

The above described step-down chopper circuit is controlled such that a current has a predetermined peak value. In an actual operation, however, the components included in the step-down chopper circuit have delay time between when the current reaches the predetermined value and when the switching element Q1 is turned OFF. Here, the variations in forward voltage of the LED unit causes an output voltage Vout of the step-down chopper circuit to be a forward voltage, so that the time rate of change of the current flowing through the inductor L1 changes.

FIG. 5 illustrates change in current flowing through the inductor L1 relative to time.

As FIG. 5 illustrates, different time rate of change of current with the same delay time results in different peak values obtained when the switching element Q1 is turned OFF. Hence, different forward voltages of the LED unit results in different smoothed currents flowing through the LED unit. More specifically, in an environment that a plurality of LED units are used, the variations in light output of individual LED units may adversely cause problems such as different levels of illuminance, color unevenness, and the like.

In particular, in a power source device used for a luminaire that includes a plurality of LED units, the variations in light output of the individual LED units are a significant problem.

Japanese Unexamined Patent Application No. 2010-40509 (hereinafter, referred to as PTL 2) discloses a technique used in a lighting device that supplies electric power to a plurality of solid-state light-emitting elements. Specifically, in the technique, a current flowing through each solid-state light-emitting element is made substantially equal to each other.

In the technique disclosed in PTL 2, an output of a DC/DC convertor serving as a DC power source is connected to a plurality of buck switching regulators. Then, it is controlled such that the current values of the LED elements connected to respective buck switching regulators are equal. Each buck switching regulator includes a switching balance controller. The switching balance controller performs feedback control by using an integrator or the like so that a current flowing through a switching element of the buck switching regulator coincides with a target value. In addition, the switching balance controller includes a feedback selection circuit that regulates an output voltage of the DC/DC convertor so as to supply electric power to the buck switching regulator.

Although the technique disclosed in PTL 2 can make a current flowing through each LED current equal, the configuration is complicated, which results in problems such as an increase in system cost.

The present invention has been conceived in order to solve the above problems. An object of the present invention is to provide a lighting device that has a simple configuration and reduces variations in current flowing through solid-state light-emitting elements which are connected to the lighting device and which have different forward voltages.

In order to achieve the above object, a lighting device according to one aspect of the present invention is a lighting device that is connected to a DC power source to supply a current to a solid-state light-emitting element. The lighting device includes: a DC/DC converter; and a control circuit. The DC/DC converter includes: a switching element that is connected to the DC power source and is turned ON and OFF; an inductor that is connected in series with the switching element, and through which the current from the DC power source flows when the switching element is ON; a diode that supplies, to the solid-state light-emitting element, the current released from the inductor; and a current detection circuit that detects a current flowing through the switching element and outputs a detected current value that is a value of the current detected. The control circuit includes: a drive circuit that turns the switching element ON and OFF; a voltage detection circuit that detects either one of a voltage across the solid-state light-emitting element and a voltage across the inductor, and outputs a detected voltage value that is a value of the voltage detected; and a correction circuit that corrects a timing at which the drive circuit turns OFF the switching element. When the drive circuit detects that the inductor has finished releasing energy, the drive circuit turns ON the switching element, and when the detected current value reaches a predetermined current command value, the drive circuit turns OFF the switching element, and the correction circuit corrects the timing at which the drive circuit turns OFF the switching element, based on the detected voltage value.

Moreover, in the lighting device according to one aspect of the present invention, it may be that the correction circuit corrects the timing at which the drive circuit turns OFF the switching element, by correcting the predetermined current command value based on the detected voltage value.

Moreover, in the lighting device according to one aspect of the present invention, it may be that the correction circuit corrects the predetermined current command value such that, in a relationship between the detected voltage value and a peak value of the detected current value, the detected current value has peaks that are substantially the same in value at at least two different detected voltage values among a plurality of the detected voltage values.

Moreover, in the lighting device according to one aspect of the present invention, it may be that when the detected voltage value is less than or equal to a first threshold value, the correction circuit corrects the predetermined current command value to a first correction value that is less than the predetermined current command value.

Moreover, in the lighting device according to one aspect of the present invention, it may be that when the detected voltage value is less than or equal to a second threshold value that is less than the first threshold value, the correction circuit further corrects the predetermined current command value to a second correction value that is less than the first correction value.

Moreover, in the lighting device according to one aspect of the present invention, it may be that the first threshold value and the second threshold value fall between values of different forward voltages of two solid-state light-emitting elements among a plurality of the solid-state light-emitting elements to be connected to the lighting device.

Moreover, in the lighting device according to one aspect of the present invention, it may be that the correction circuit corrects the predetermined current command value such that a peak value of the current flowing through the inductor is constant regardless of the voltage detected by the voltage detection circuit.

Moreover, in the lighting device according to one aspect of the present invention, it may be that the correction circuit corrects the predetermined current command value such that the predetermined current command value after correction has a positive correlation with the detected voltage value.

In the lighting device according to one aspect of the present invention, it may be that the correction circuit corrects the timing at which the drive circuit turns OFF the switching element, by correcting the detected current value based on the detected voltage value.

Moreover, in the lighting device according to one aspect of the present invention, it may be that the correction circuit corrects the detected current value such that the detected current value after correction has a negative correlation with the detected voltage value.

Moreover, the lighting device according to one aspect of the present invention may include a plurality of sets each including the DC/DC converter and the control circuit.

Moreover, the lighting device according to aspect of the present invention may further include a dimming control circuit that changes the predetermined current command value.

Moreover, a luminaire according to one aspect of the present invention include the lighting device; and a solid-state light-emitting element.

According to one aspect of the present invention, it is possible to provide a lighting device that has a simple configuration and reduces variations in current flowing through solid-state light-emitting elements connected to the lighting device and which have different forward voltages.

BRIEF DESCRIPTION OF THE DRAWINGS

The figures depict one or more implementations in accordance with the present teaching, by way of examples only, not by way of limitations. In the figures, like reference numerals refer to the same or similar elements.

DETAILED DESCRIPTION

In the following, a lighting device and a luminaire according to embodiments of the present invention will be described, with reference to accompanying drawings. It should be noted that any of the embodiments described below will illustrate one specific preferable example of the present invention. The numerical values, shapes, materials, structural components, the arrangement and connection of the structural components, steps and the order of the steps mentioned in the following embodiments are merely an example and not intended to limit the present invention. Among the structural components in the following embodiments, the one that is not recited in any independent claim exhibiting the most generic concept of the present invention will be described as an arbitrary structural component.

It should be noted that the Drawings are schematic drawings, and are not necessarily exact depictions.

Embodiment 1

First, a lighting device and a luminaire according to Embodiment 1 of the present invention will be described.

Figure 1:
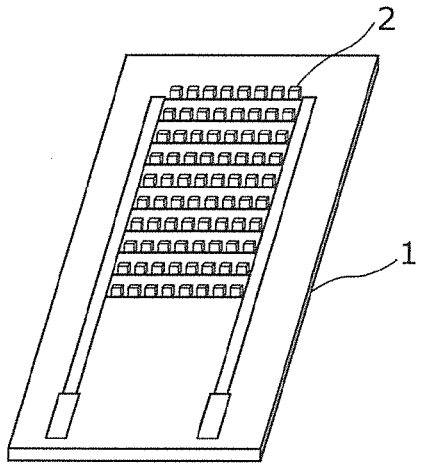
FIG. 1 PRIOR ART
FIG. 1 illustrates an external appearance of an LED unit that includes a plurality of LED elements connected in series-parallel.
Figure 6:
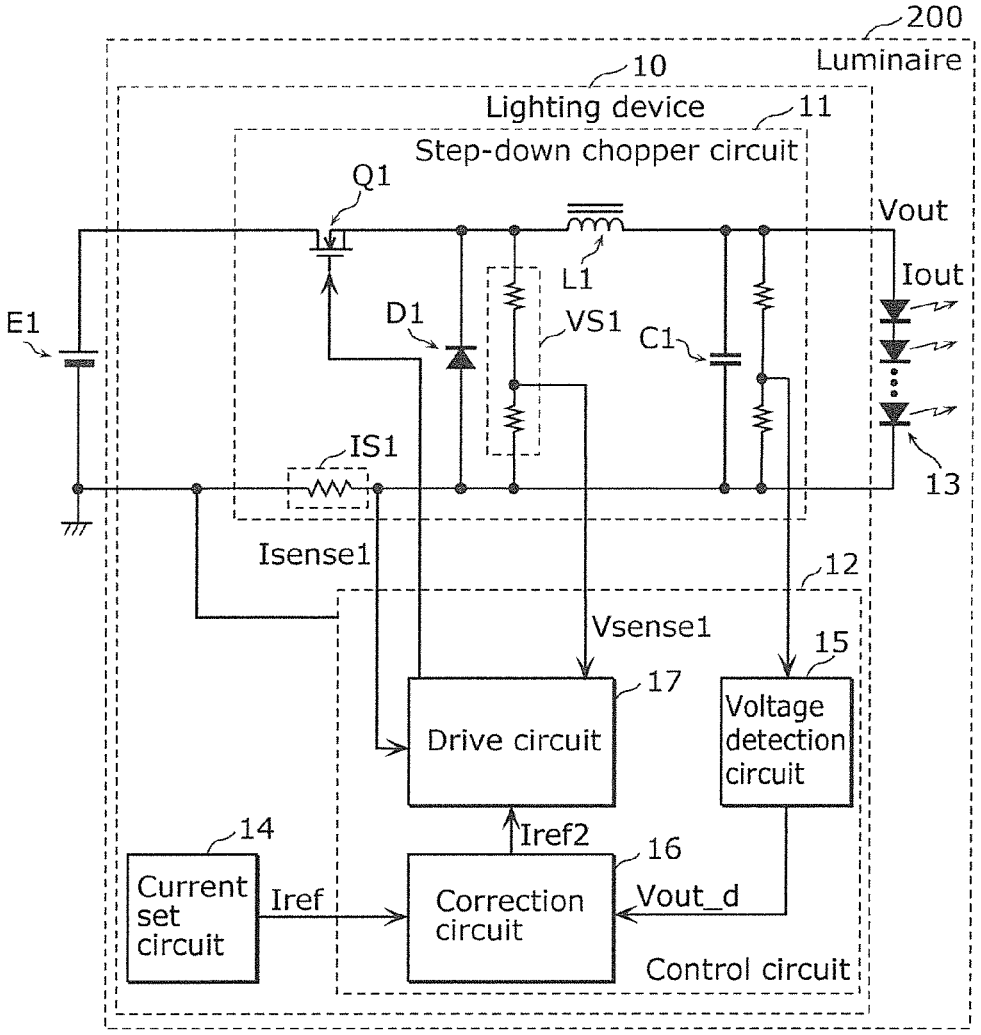
FIG. 6 is a circuit diagram of a lighting device and a luminaire according to Embodiment 1.

FIG. 6 is a schematic circuit diagram of a lighting device 10 and a luminaire 200 according to Embodiment 1. FIG. 1 illustrates not only the lighting device 10 and the luminaire 200, but also a DC power source E1 that supplies DC power to the lighting device 10.

The luminaire 200 includes: the lighting device 10; and an LED unit 13 including an LED element that is one type of a solid-state light-emitting element. The LED unit 13 may be a single LED chip, or an LED module that includes a plurality of LEDs connected in series, in parallel, or in series-parallel.

The lighting device 10 includes: a step-down chopper circuit 11 that is one type of a DC/DC converter; a control circuit 12; and a current set circuit 14.

The step-down chopper circuit 11 includes a switching element Q1, an inductor L1, a diode D1, an output capacitor C1, a current detection circuit IS1, and a diode voltage detection circuit VS1.

The switching element Q1 is an element connected to the DC power source E1, and is turned ON and Off.

The inductor L1 is connected in series with the switching element Q1. A current from the DC power source E1 flows through the inductor L1 when the switching element Q1 is ON.

The diode D1 is an element that supplies, to the LED unit 13, a current released from the inductor L1.

The output capacitor C1 is an element that smoothes the current supplied to the LED unit 13.

The current detection circuit IS1 is a circuit that detects the current flowing through the inductor L1, and outputs a detected current value Isense1.

The diode voltage detection circuit VS1 is a circuit that detects a voltage across a diode, and outputs a detected value Vsense1.

The control circuit 12 includes a drive circuit 17, a voltage detection circuit 15, and a correction circuit 16.

The drive circuit 17 is a circuit that turns the switching element Q1 ON and OFF. When the drive circuit 17 detects that the inductor L1 has finished releasing energy, the drive circuit 17 turns ON the switching element Q1. When the detected current value Isense1 reaches a predetermined current command value, the drive circuit 17 turns OFF the switching element Q1.

The voltage detection circuit 15 is a circuit that detects a voltage across the LED unit 13, and outputs a detected voltage value Vout_d.

The correction circuit 16 is a circuit that corrects the timing at which the drive circuit 17 turns OFF the switching element Q1 based on the detected voltage value Vout_d. The correction is performed such that an average current flowing through the inductor L1 has a value within a predetermined range regardless of the detected voltage value Vout_d.

The current set circuit 14 is a circuit that outputs, to the control circuit 12, a signal indicating a current command value that is a target value of the peak value of a current flowing through the inductor L1.

Figure 7:
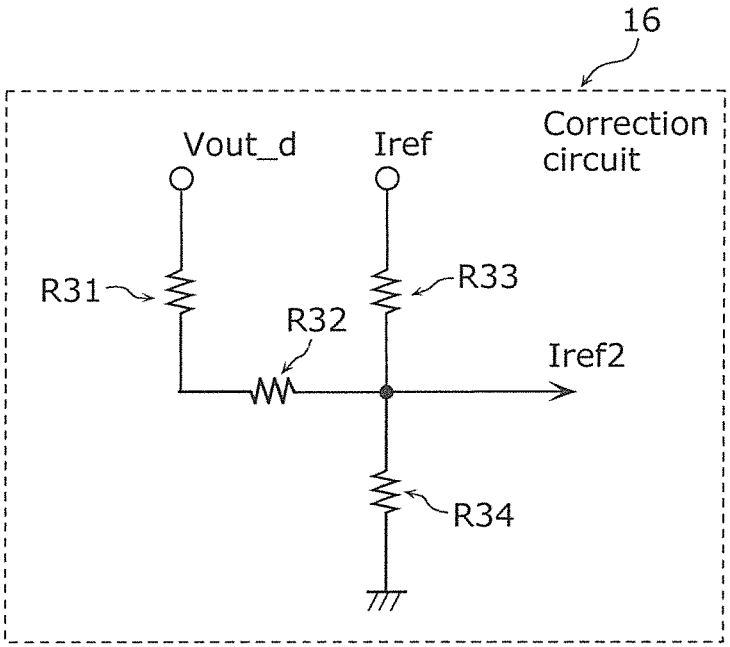
FIG. 7 is a circuit diagram of a correction circuit according to Embodiment 1.

FIG. 7 is a circuit diagram illustrating an example of the correction circuit 16 illustrated in FIG. 6.

The correction circuit 16 illustrated in FIG. 7 includes resistors R31, R32, R33, and R34.

Figure 8:
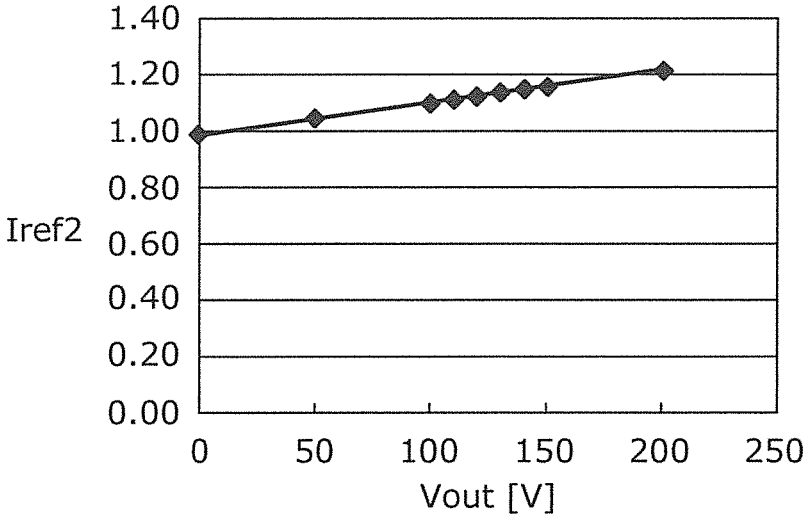
FIG. 8 is a graph showing a relationship between Vout and Iref2 in the lighting device according to Embodiment 1.

FIG. 8 illustrates a relationship between a corrected current command value Iref2 and a voltage Vout across the LED unit 13 obtained when a predetermined current command value Iref and the detected value Vout_d of the voltage across the LED unit 13 are inputted to the correction circuit 16 illustrated in FIG. 7.

As FIG. 8 illustrates, when the voltage Vout across the LED unit 13 increases, the corrected current command value Iref2 increases.

Next, a description is given of an operation of the lighting device 10 according to Embodiment 1 configured as above.

Figure 2:
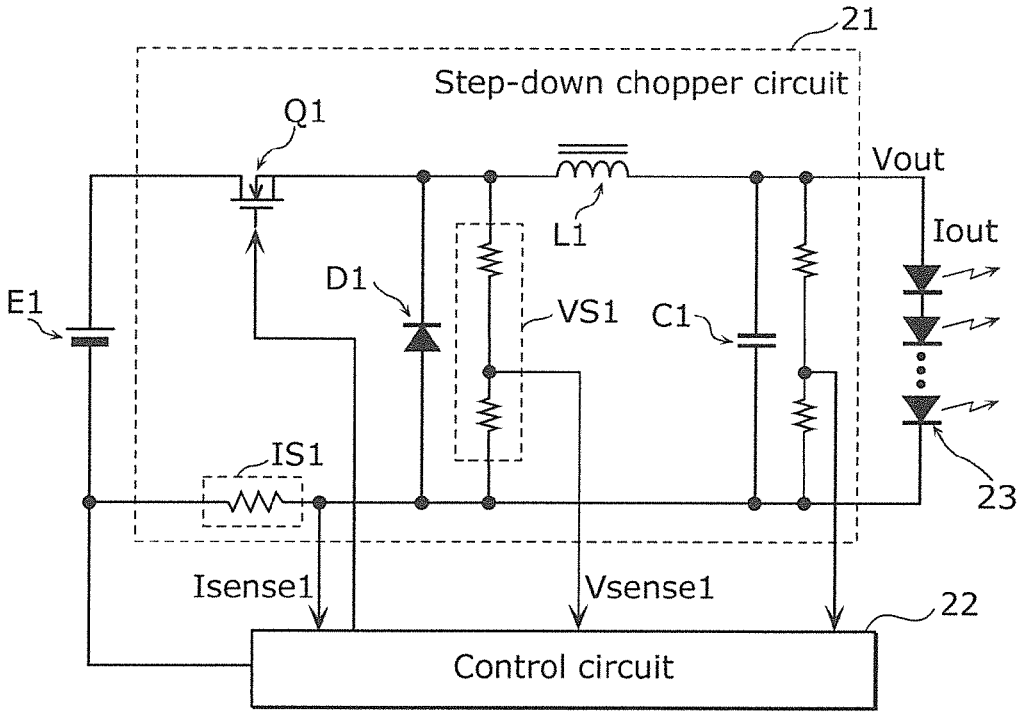
FIG. 2 PRIOR ART
FIG. 2 is a circuit diagram of a lighting device of a background art.
Figure 3:
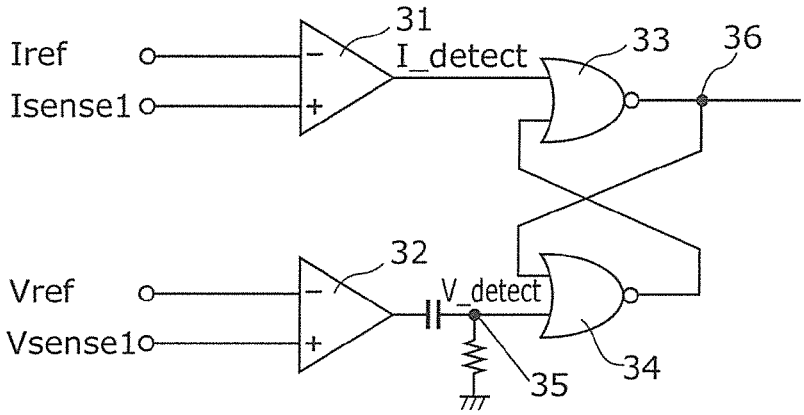
FIG. 3 PRIOR ART
FIG. 3 is a circuit diagram of a control circuit included in the lighting device of the background art.
Figure 4:
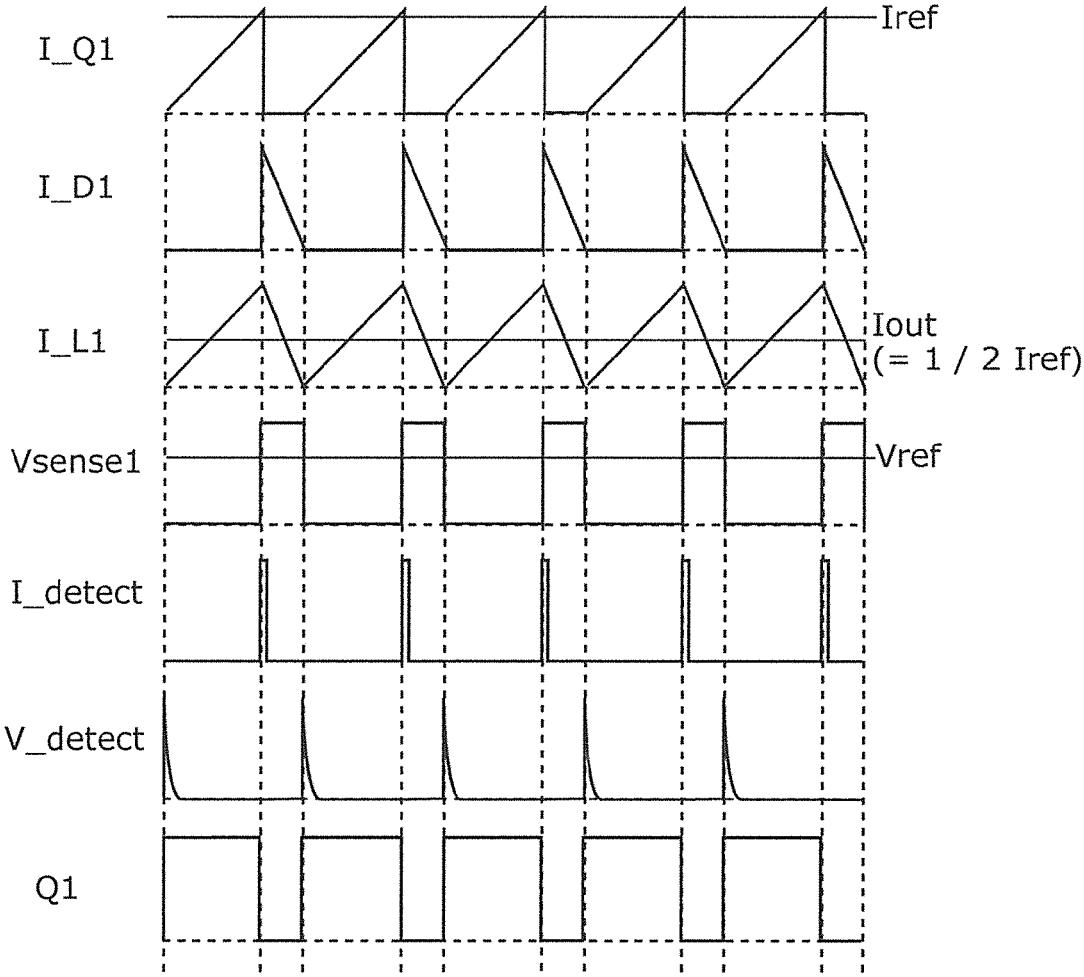
FIG. 4 PRIOR ART
FIG. 4 is a timing chart illustrating operations of respective elements included in the lighting device of the background art.
Figure 5:
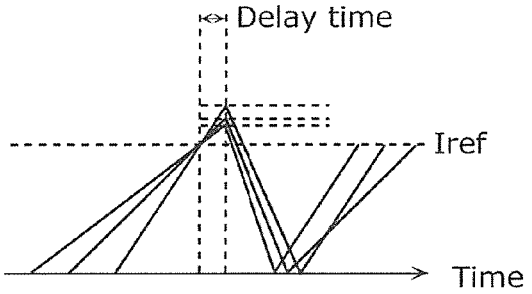
FIG. 5 PRIOR ART
FIG. 5 illustrates temporal change in current flowing through an inductor included in the lighting device of the background art.

When the switching element Q1 is turned ON by the drive circuit 17, a current from the DC power source E1 flows through the LED unit 13 via the switching element Q1, the inductor L1, and the output capacitor C1. Here, as described in the background art section referring to FIG. 2, the current flowing through the inductor L1 has a time rate of change that depends on the voltage across the LED unit 13.

The current flowing through the inductor L1 is detected by the current detection circuit IS1, and the Isense1 that is a detected value is inputted to the drive circuit 17.

The voltage across the LED unit 13 is detected by the voltage detection circuit 15, and the detected value Vout_d is inputted to the correction circuit 16. Furthermore, a current command value Iref is inputted from the current set circuit 14 to the correction circuit 16.

The correction circuit 16 corrects the current command value Iref based on the detected value Vout_d to generate a corrected current command value Iref2, and outputs the corrected current command value Iref2 to the drive circuit 17.

The drive circuit 17 compares the corrected current command value Iref2 and the detected value Isense1 of the current flowing through the inductor L1. When the drive circuit 17 detects that the Isense 1 has reached the Iref2, the drive circuit 17 switches the switching element Q1 from ON to OFF.

As described above, the corrected current command value Iref2 increases as the detected value Vout_d increases. In other words, the time rate of change of the current flowing through the inductor L1 decreases as the detected value Vout_d increases. Hence, the Iref2 increases as the time rate of change of the current flowing through the inductor L1 decreases. Accordingly, for example, when the Vout_d increases, the current command value is corrected to the Iref2 that is a value greater than the current command value Iref before correction. As a result, the peak value of the current flowing through the inductor L1 increases. In other words, it is possible to reduce variations in peak value of the current flowing through the inductor L1 when the Vout_d varies.

When the switching element Q1 is turned OFF, the energy stored in the inductor L1 is released. The drive circuit 17 switches the switching element Q1 from OFF to ON when the drive circuit 17 detects through the voltage value Vsense1 that the inductor L1 has finished releasing energy. The voltage value Vsense1 is an output of the diode voltage detection circuit VS1.

The lighting device 10 can keep the current flowing through the LED unit 13 constant by the operation as above.

Embodiment 2

Next, a lighting device and a luminaire according to Embodiment 2 will be described.

Figure 9:
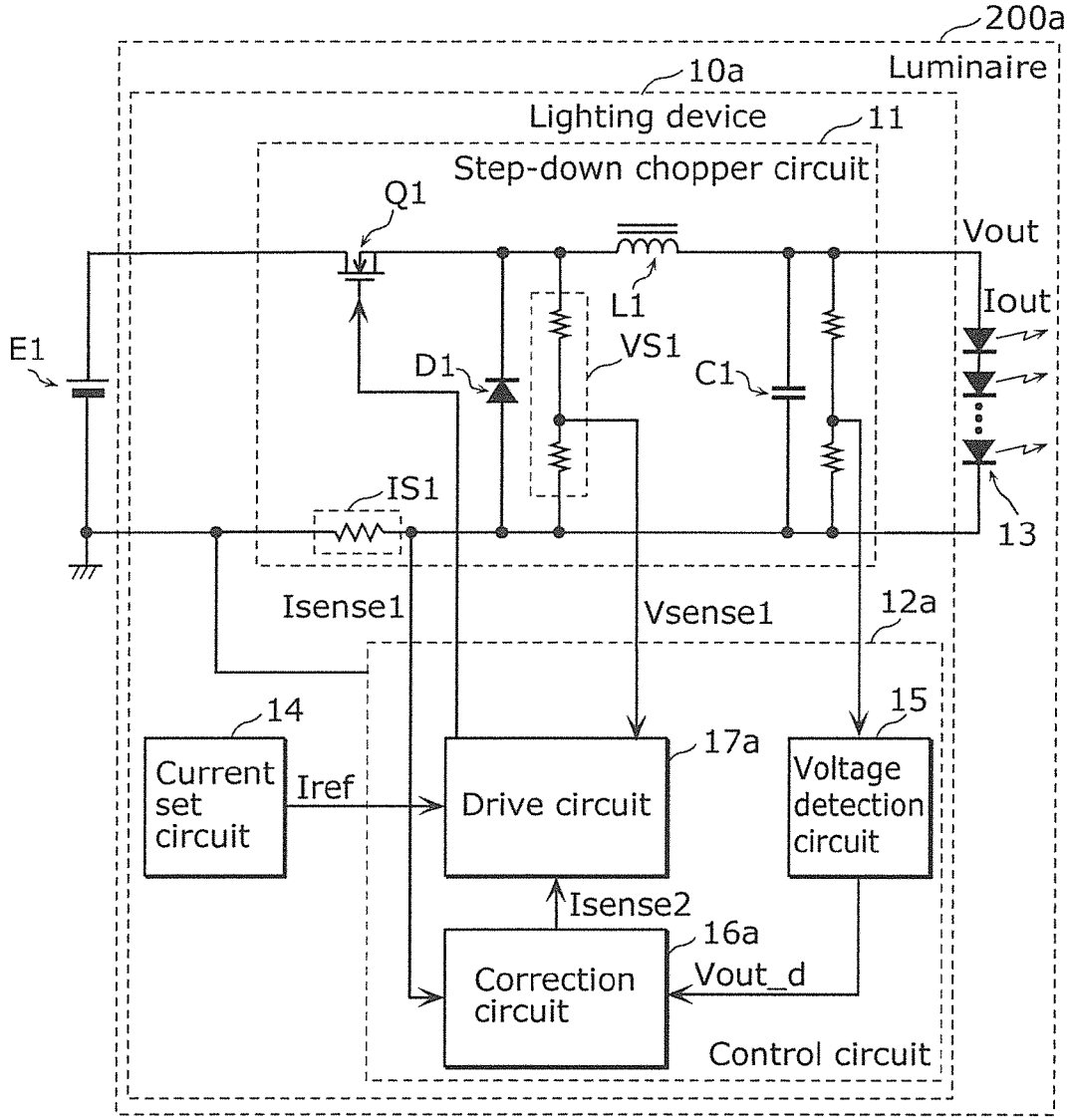
FIG. 9 is a circuit diagram of a lighting device and a luminaire according to Embodiment 2.

FIG. 9 is a schematic circuit diagram of a lighting device 10*a* and a luminaire 200*a* according to Embodiment 2.

Embodiment 2 is different from Embodiment 1 in that a correction circuit 16*a* in a control circuit 12*a* corrects the detected value Isense1 of the current detection circuit IS1 and outputs a corrected detected current value Isense2.

Figure 10:
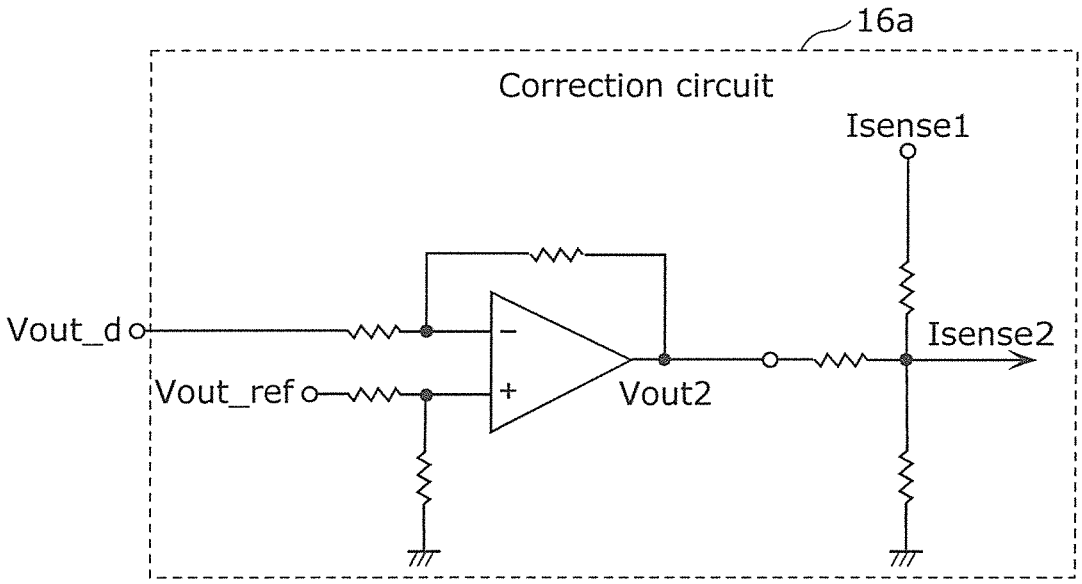
FIG. 10 is a circuit diagram of a correction circuit according to Embodiment 2.

FIG. 10 is a circuit diagram illustrating an example of the correction circuit 16*a*.

As FIG. 10 illustrates, the correction circuit 16*a* constitutes a subtraction circuit.

The correction circuit 16*a* receives a detected value Vout_d of a voltage across the LED unit 13, a reference voltage value Vout_ref, and a detected current value Isense1. When the Vout_d and the Vout_ref are inputted to the subtraction circuit of the correction circuit 16*a*, a signal Vout2 which decreases as the Vout_d increases is outputted from the subtraction circuit to the drive circuit 17*a*.

Accordingly, the correction circuit 16*a* illustrated in FIG. 10 is capable of generating the Isense2 that decreases as the Vout_d increases.

In Embodiment 2, when the Vout_d increases, the time rate of change of the current flowing through the inductor L1 decreases. However, the detected current value is corrected to a smaller value, delaying the timing at which the switching element Q1 is turned OFF. Hence, it is possible to reduce that the peak value of the current flowing through the inductor L1 decreases when the Vout_d increases.

The lighting device 10*a* can keep the current flowing through the LED unit 13 constant by the operation as above.

Embodiment 3

Next, a lighting device and a luminaire according to Embodiment 3 will be described.

Figure 11:
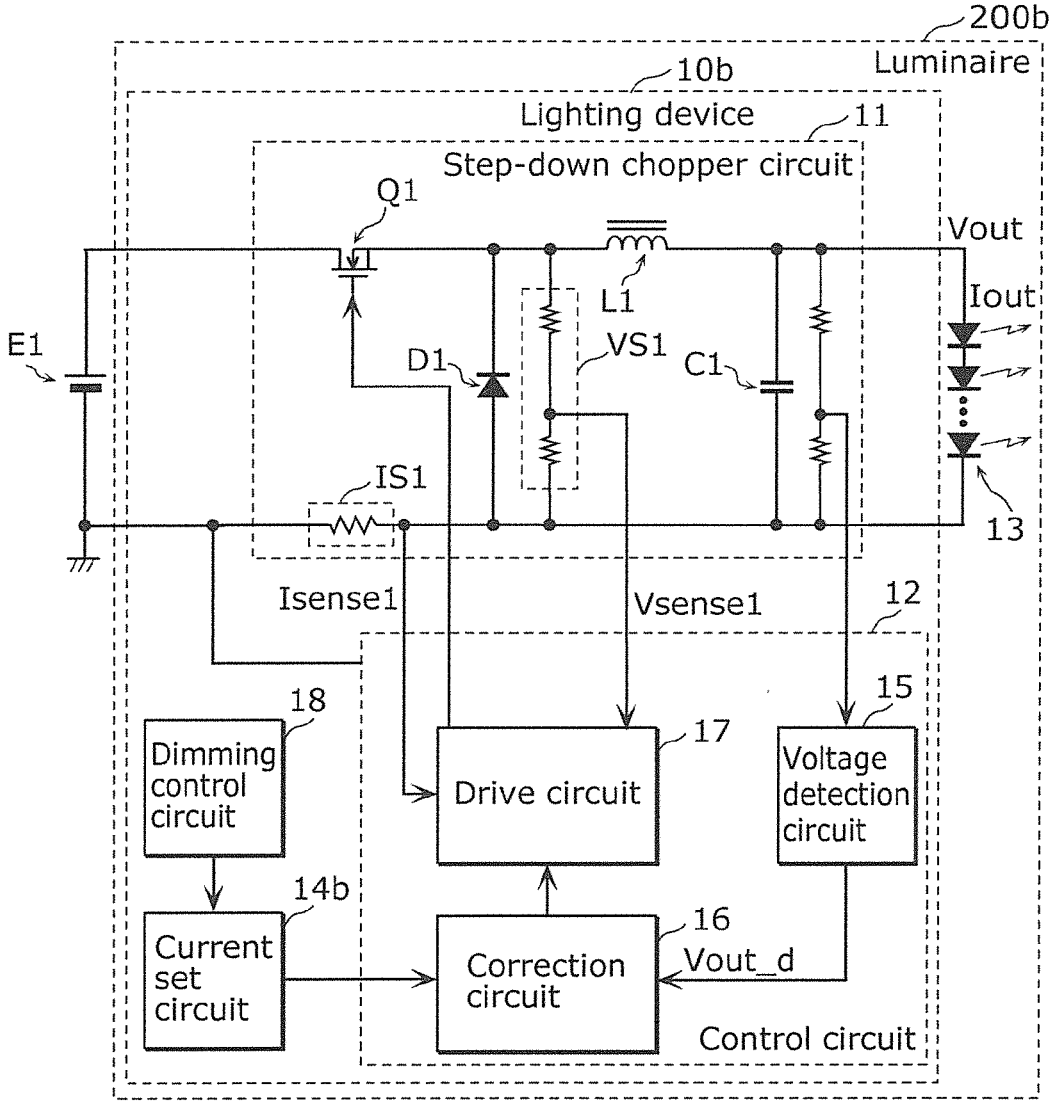
FIG. 11 is a circuit diagram of a lighting device and a luminaire according to Embodiment 3.

FIG. 11 is a schematic circuit diagram of a lighting device 10*b* and a luminaire 200*b* according to Embodiment 3.

The lighting device 10*b* according to Embodiment 3 is different from Embodiment 1 in that a dimming control circuit 18 is included.

The dimming control circuit 18 is a circuit that can dim the LED unit 13 by changing an Iref that is an output of a current set circuit 14*b*.

The lighting device 10*b* reduces unnecessary variations in light output of the LED unit 13 that is caused by variations in voltage across the LED unit 13 during dimming by the dimming control circuit 18. As a result, appropriate dimming can be achieved.

In Embodiment 3, the dimming control circuit 18 is added to the lighting device 10 according to Embodiment 1. It may also be that the dimming control circuit 18 is added to the lighting device 10*a* according to Embodiment 2.

Embodiment 4

Next, a lighting device and a luminaire according to Embodiment 4 will be described.

Figure 12:
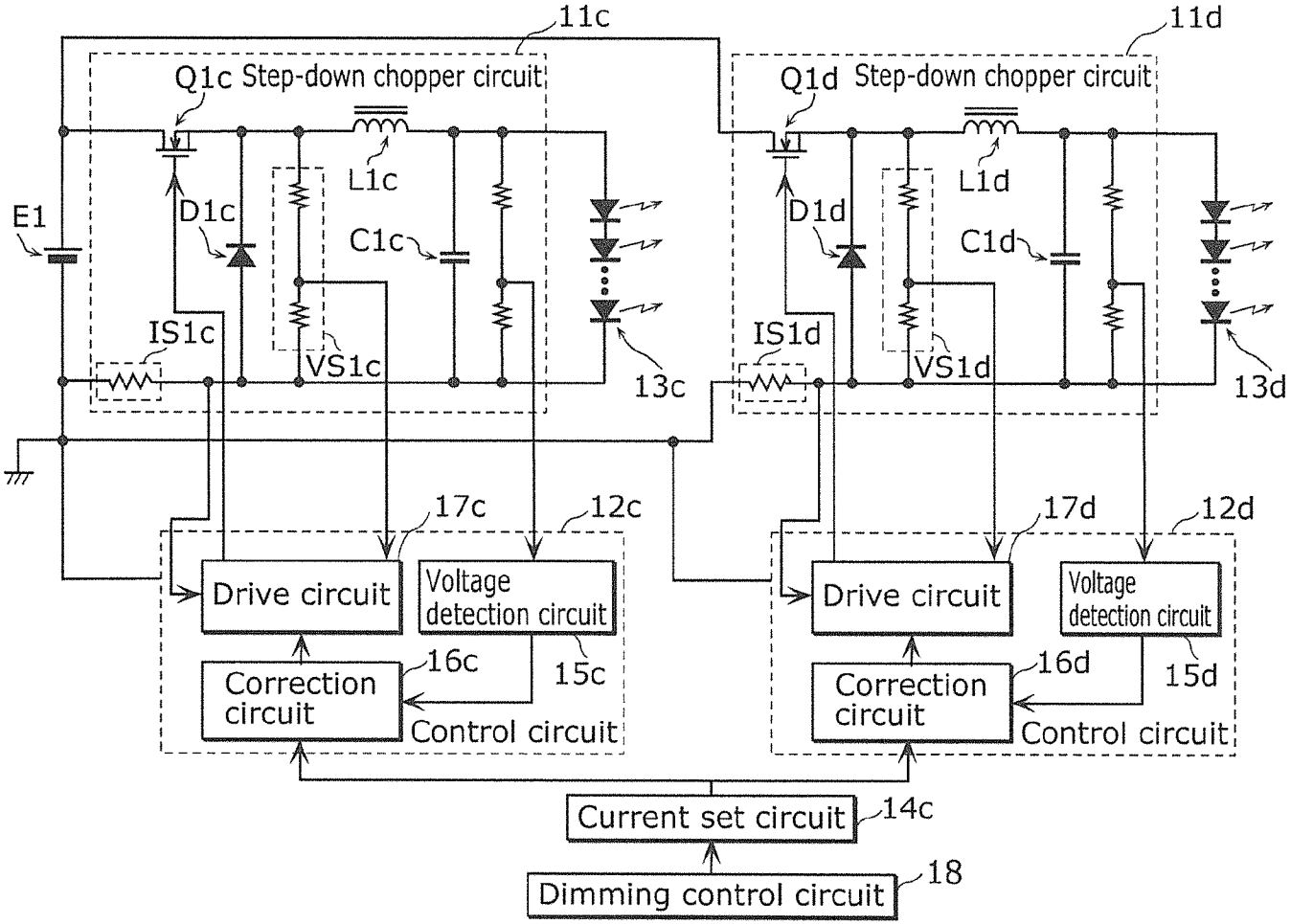
FIG. 12 is a circuit diagram of a lighting device according to Embodiment 4.

FIG. 12 is a schematic circuit diagram of a lighting device according to Embodiment 4.

Embodiment 4 is different from Embodiment 3 in that the lighting device includes two step-down chopper circuits 11*c* and 11*d* and two control circuits 12*c* and 12*d*.

The lighting device according to Embodiment 4 can collectively perform dimming control on two LED units 13*c* and 13*d* by causing a current set circuit 14*c* to output a current command value common to the two control circuits 12*c* and 12*d*.

In Embodiment 4, it is also possible to reduce variations in light output of the two LED units 13*c* and 13*d*.

The luminaire according to Embodiment 4 is particularly suitable when two LED units are provided in a single luminaire for use.

The control circuit in Embodiment 1 is used in the lighting device according to Embodiment 4, but the control circuit in Embodiment 2 may be used.

Moreover, in Embodiment 4, two sets of the step-down chopper circuit, the control circuit, and the LED unit are included. It may also be that three sets or more are included.

Embodiment 5

Next, a lighting device according to Embodiment 5 will be described.

Figure 13:
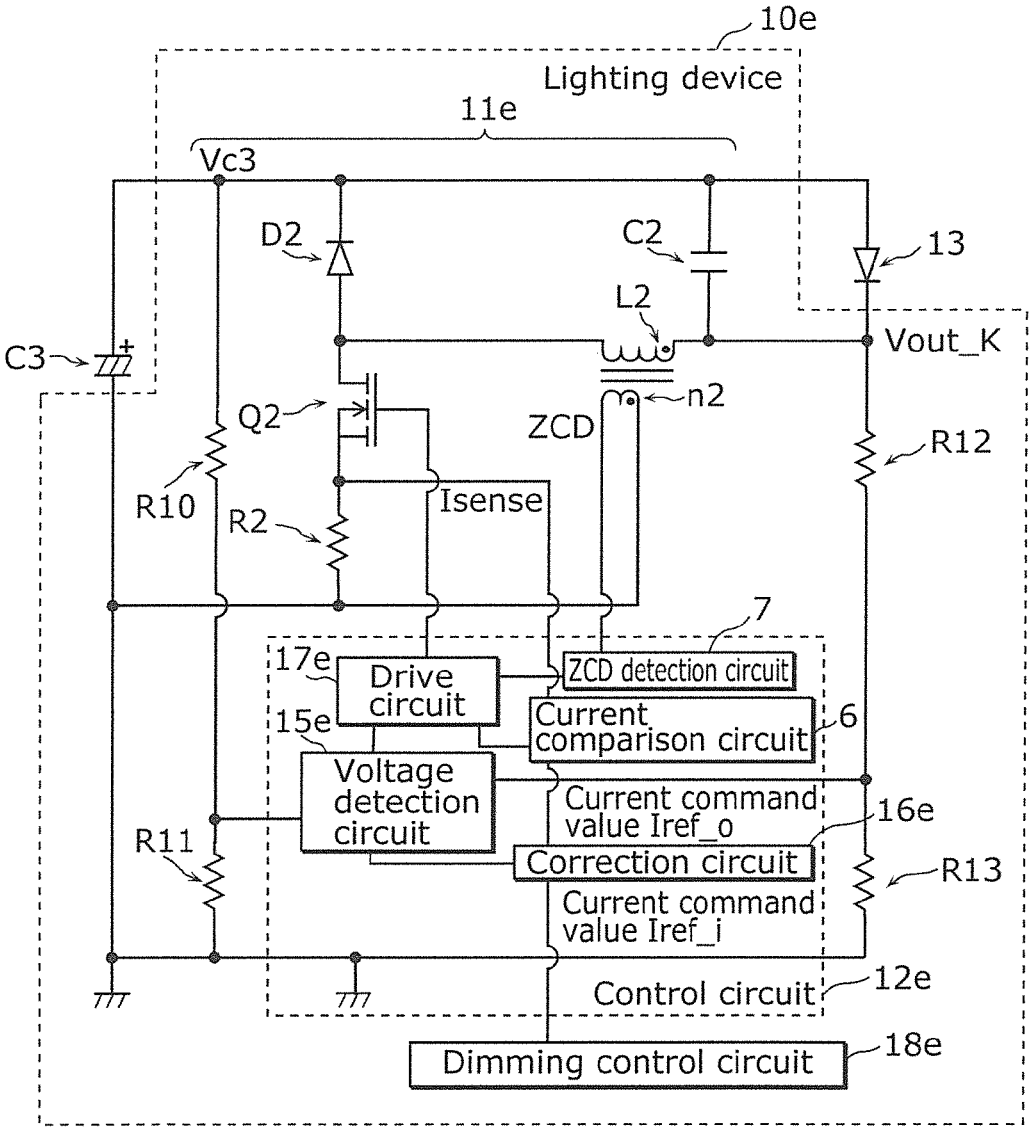
FIG. 13 is a circuit diagram of a lighting device according to Embodiment 5.
Figure 14:
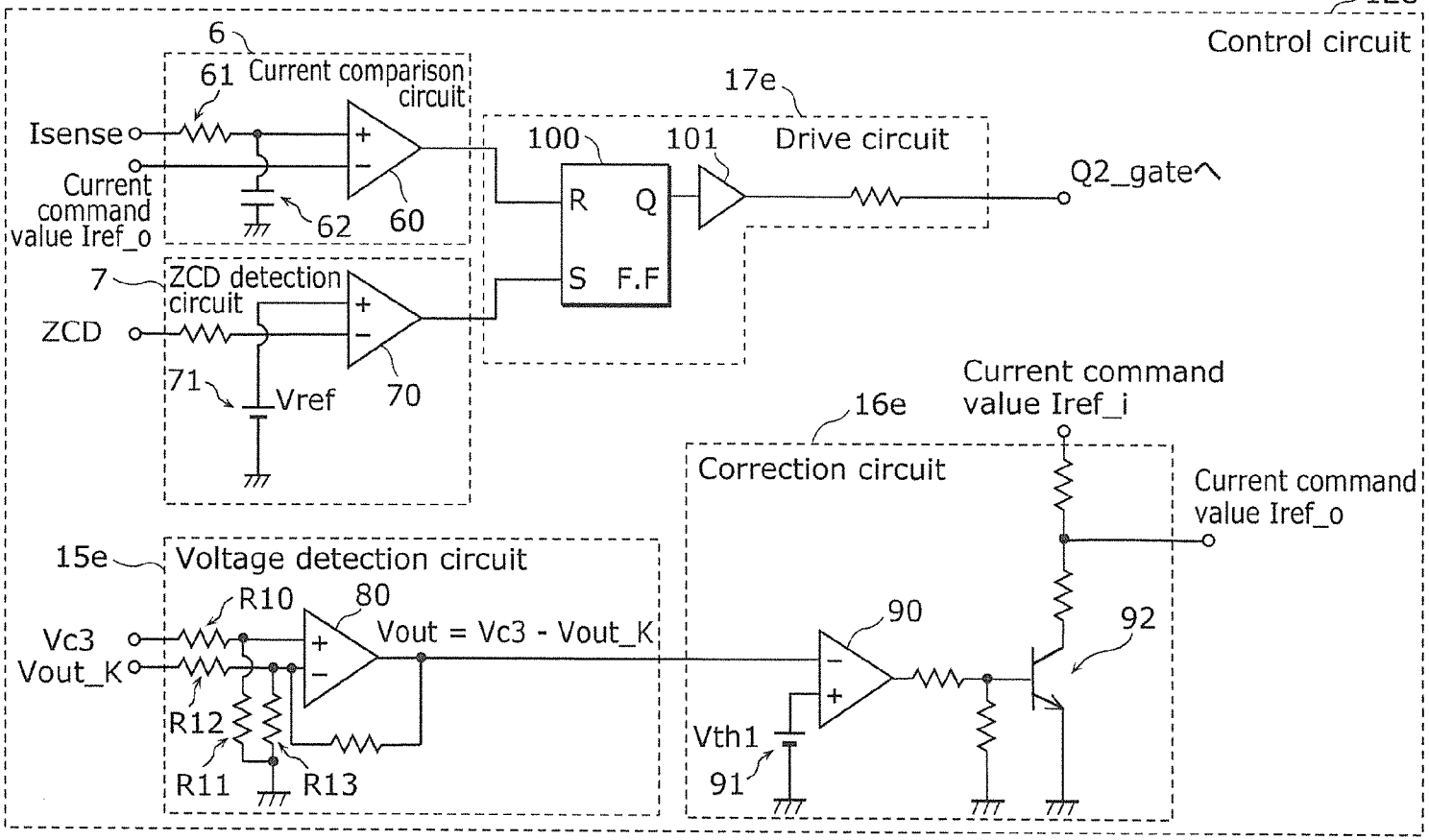
FIG. 14 is a detailed circuit diagram of a control circuit included in a lighting device according to Embodiment 5.

FIG. 13 is a circuit diagram of a lighting device 10*e* according to Embodiment 5. FIG. 14 is a detailed circuit diagram of a control circuit 12*e* included in the lighting device 10*e*. In Embodiment 5, a step-down chopper circuit 11*e* and the control circuit 12*e* are used which have different configurations from those in the above embodiments.

The lighting device 10*e* includes the step-down chopper circuit 11*e*, the control circuit 12*e* that controls the step-down chopper circuit 11*e*, and a dimming control circuit 18*e*. The step-down chopper circuit 11*e* receives a current from a smoothing capacitor C3 serving as a DC power source, and supplies a predetermined current to an LED unit 13. In other words, the lighting device 10*e* includes the step-down chopper circuit 11*e*, the control circuit 12*e* for the step-down chopper circuit 11*e*, and the dimming control circuit 18*e*. The step-down chopper circuit 11*e* steps down a DC voltage of the smoothing capacitor C3 and supplies a DC current to a solid-state light-emitting element (here, the LED unit 13) serving as a load.

In Embodiment 5, the smoothing capacitor C3 is included as a DC power source. The smoothing capacitor C3 is, for example, charged with a DC voltage obtained by full-wave rectifying a commercial AC power source with a full-wave rectifier (not illustrated). In general, an AC input side of the full-wave rectifier is provided with a filter circuit for removing a high frequency component. Further, a power factor improvement circuit using a boosting chopper circuit or the like may be provided between a DC output side of the full-wave rectifier and the smoothing capacitor C3.

Moreover, in Embodiment 5, the dimming control circuit 18*e* includes the functions of the current set circuit in each of the above embodiments. The dimming control circuit 18*e* transmits a current command value Iref_i to the control circuit 12*e* (more precisely, to a current comparison circuit 6 in the control circuit 12*e*). Accordingly, the dimming control circuit 18*e*, for example, receives an external dimming signal (not illustrated), sets a target of an output current Iout of the lighting device 10*e* that can achieve a desired light output, and calculates the current command value Iref_i for achieving the output current Iout. The current command value Iref_i is, for example, a voltage corresponding to the magnitude of the output current to be commanded.

The step-down chopper circuit 11*e* includes a switching element Q2, an inductor L2 and a diode D2 as major structural components. The inductor L2 is connected in series with the switching element Q2 and the LED unit 13 that is lit up with a DC current. A current from the smoothing capacitor C3 flows through the inductor L2 when the switching element Q2 is ON. The switching element Q2 is an element for connecting a series circuit including the inductor L2 and the LED unit 13 across the smoothing capacitor C3 serving as a DC power source, and is, for example, a transistor. The diode D2 is a regenerative diode that supplies, to the LED unit 13, a current released from the inductor L2. In other words, the diode D2 is connected in parallel with the series circuit including the inductor L2 and the LED unit 13, and releases a stored energy of the inductor L2 to the LED unit 13 when the switching element Q2 is OFF. Further, an output capacitor C2 is connected in parallel with the LED unit 13. The output capacitor C2 has a capacity set so as to smooth a pulsating component generated due to ON/OFF of the switching element Q2, thus allowing a smoothed DC current to flow through the LED unit 13. The LED unit 13 may be a single LED chip or an LED module obtained by connecting a plurality of LEDs in series, in parallel or in series-parallel.

Resistors R12 and R13 illustrated in FIG. 13 are voltage dividing resistors for detecting a voltage Vout_K at a connection point of the LED unit 13 and the inductor L2, and belong to a voltage detection circuit 15*e* as described later. The voltage Vout_K is also a voltage at a cathode of the LED unit 13 and thus also referred to as a cathode voltage Vout_K. In a similar manner, resistors R10 and R11 are voltage dividing resistors for detecting a voltage Vc3 across the smoothing capacitor C3, and belong to the current detection circuit 15*e* as described later. The resistor R2 is a resistor that constitutes a current detection circuit for detecting a current flowing through the switching element Q2.

The control circuit 12*e* generates a signal that turns the switching element Q2 ON and OFF at high frequencies, and controls a current IL2 flowing through the inductor L2 so that an appropriate current flows through the load (LED unit 13). The control circuit 12*e* includes the current comparison circuit 6, a ZCD detection circuit 7, the voltage detection circuit 15*e*, a correction circuit 16*e*, and a drive circuit 17*e*.

FIG. 14 illustrates a simplified internal configuration of the control circuit 12*e* used in Embodiment 5.

The current comparison circuit 6 monitors a voltage at a connection point of the resistor R2 for current detection and the switching element Q2, thereby detecting a current flowing through the switching element Q2 as a detected value Isense. More specifically, as illustrated in FIG. 14, the current comparison circuit 6 includes a comparator 60, a resistor 61 and a capacitor 62. In the current comparison circuit 6, a signal indicating the detected value Isense is smoothed by a low pass filter composed of the resistor 61 and the capacitor 62, and inputted to the comparator 60. Then, the comparator 60 compares the detected value Isense and a current command value Iref_o from the correction circuit 16*e*, and outputs a signal indicating when the detected value Isense is greater than the current command value Iref_o to the drive circuit 17*e*.

The ZCD detection circuit 7 is an example of a circuit for detecting a time when the inductor L2 releases a predetermined energy. In Embodiment 5, the ZCD detection circuit 7 detects that a voltage of a secondary winding n2 coupled to the inductor L2 is less than or equal to a threshold voltage Vref, thereby detecting that the current IL2 reaches substantially zero. More specifically, as illustrated in FIG. 14, the ZCD detection circuit 7 includes a comparator 70, a reference voltage generator 71 for generating the threshold voltage Vref, and so on. The ZCD detection circuit 7 compares, by the comparator 70, the voltage of the secondary winding n2 coupled to the inductor L2 and the threshold voltage Vref generated by the reference voltage generator 71. Subsequently, the ZCD detection circuit 7 outputs a signal indicating when the voltage of the secondary winding n2 is less than the threshold voltage Vref to the drive circuit 17*e*.

The voltage detection circuit 15*e* is an example of a circuit for detecting a voltage (forward voltage) across the LED unit 13 or a voltage across the inductor L2. In Embodiment 5, the voltage detection circuit 15*e* is a circuit that detects the voltage Vout across the LED unit 13 serving as a load. As FIG. 14 illustrates, the voltage detection circuit 15*e* includes a differential amplifier 80 for detecting the difference between a voltage Vc3 and the cathode output voltage Vout_K. In the voltage detection circuit 15*e*, the differential amplifier 80 subtracts a voltage obtained by dividing the voltage Vout_K of the cathode side 1 of the LED unit 13 with the resistors R12 and R13 from a voltage obtained by dividing the voltage Vc3 of the anode side of the LED unit 13 with the resistors R10 and R11. The voltage detection circuit 15*e* then amplifies the obtained value. With this, the differential amplifier 80 calculates the output voltage Vout (Vout=Vc3−Vout_K) to the LED unit 13, and outputs the calculated output voltage Vout to the correction circuit 16*e*.

The correction circuit 16*e* corrects the current command value Iref_i from the dimming control circuit 18*e* according to the voltage detected by the voltage detection circuit 15*e* (here, output voltage Vout). The correction circuit 16*e* outputs the corrected value as a current command value Iref_o after correction to the current comparison circuit 6. More specifically, the correction circuit 16*e* corrects the current command value Iref_i such that, in the relationship between a voltage detected by the voltage detection circuit 15*e* (here, output voltage Vout) and the peak value of a current flowing through the inductor L2, the current has peaks that are substantially the same in value at at least two different voltages (output voltage Vout). In order to do so, as FIG. 14 illustrates, the correction circuit 16*e* includes a comparator 90, a reference voltage generator 91 that generates a reference voltage (first threshold value) Vth1, a transistor 92, and the like. The comparator 90 compares the output voltage Vout from the voltage detection circuit 15*e* and the first threshold value Vth1 from the reference voltage generator 91. According to the result of the comparison, the transistor 92 is turned ON or OFF. According to the result of the comparison, the current command value Iref_i from the dimming control circuit 18*e* is outputted as the current command value Iref_o after division with the resistors or without division. More specifically, when the output voltage Vout from the voltage detection circuit 15*e* is less than or equal to the first threshold value Vth1, the transistor 92 is turned ON. Subsequently, the current command value Iref_i from the dimming control circuit 18*e* is outputted as the current command value Iref_o that is a value less than the current command value Iref_i.

The drive circuit 17*e* generates a control signal for turning the switching element Q2 ON and OFF, and outputs the generated control signal to the gate of the switching element Q2. This control signal turns OFF the switching element Q2 when it is detected that the current value detected by the current comparison circuit 6 (detected value Isense) has reached a predetermined current command value (current command value Iref_o). Further, the control signal turns ON the switching element Q2 when it is detected that the inductor L2 has released a predetermined energy (in Embodiment 5, when the ZCD detection circuit 7 detects that the current IL2 reaches substantially zero). In other words, the drive circuit 17*e* is a circuit that receives the results of detection by the current comparison circuit 6 and the ZCD detection circuit 7, generates a gate signal of the switching element Q2, and drives the switching element Q2. Since the resistor R2 is a small resistor for current detection, it does not substantially affect the gate signal.

More specifically, as FIG. 14 illustrates, the drive circuit 17*e* includes a flip-flop 100, a buffer amplifier 101 and so on. The flip-flop 100 is reset when the current detected by the current comparison circuit 6 (the detected value Isense) reaches the predetermined current command value Iref_o. Then, the flip-flop 100 is set when the inductor L2 has released the predetermined energy (when the ZCD detection circuit 7 detects that the current IL2 reaches substantially zero). The buffer amplifier 101 outputs an output signal from the flip-flop 100 to the gate of the switching element Q2 as a control signal.

Next, a description is given of an operation of the lighting device 10*e* according to Embodiment 5 configured as above.

First, peak current control and Boundary Current Mode (BCM) control, which are basic operations of the step-down chopper circuit 11*e* in Embodiment 5, will be described. They are the same as the operations described in PTL 1. In the peak current control, the switching element Q2 is turned OFF when the current IL2 of the inductor L2 reaches a predetermined value. In the BCM control, the switching element Q2 is turned ON when the current IL2 reaches substantially zero.

When the switching element Q2 is ON, a current flows from a positive electrode of the smoothing capacitor C3 via the output capacitor C2, the inductor L2, the switching element Q2 and the resistor R2 to a negative electrode of the smoothing capacitor C3. At this time, a chopper current i flowing through the inductor L2 increases substantially linearly unless the inductor L2 is magnetically saturated. The voltage across the inductor L2 is a difference between the voltage Vc3 across the smoothing capacitor C3 and a voltage Vc2 across the output capacitor C2. Hence, the current i of the inductor L2 has a substantially constant inclination di/dt (≈(Vc3−Vc2)/L2). Thus, when the voltage Vc2 across the output capacitor C2, namely, the output voltage thereof is high, the current i of the inductor L2 slowly increases. When the output voltage thereof is small, the current i increases rapidly.

The value of a current flowing through the inductor L2 while the switching element Q2 is ON is detected by the current comparison circuit 6 from the voltage generated in the resistor R2 connected in series with the switching element Q2. The current comparison circuit 6 includes, for example, the comparator 60 that compares the detected value Isense and the current command value Iref_o. The current command value Iref_o is a value obtained by correcting the current command value Iref_i from the dimming control circuit 18*e* by the correction circuit 16*e*. The current command value Iref_i is set by the dimming control circuit 18*e* so that a current peak target value Ipeak_T is twice as much as a target value Iout_T of the output current according to a detection ratio of the detected current value Isense detected by the resistor R2 (a ratio between an actual current value and a detected voltage). For example, when R2=0.1Ω and Iout_T=1 A, Ipeak_T=2 A and Iref=0.2 V.

Thus, when an inductor current reaches the current peak target value ipeak_T defined by the current command value Iref, the detected value Isense of the current comparison circuit 6 exceeds the current command value Iref_o, so that an output of the comparator 60 results in a High level. Consequently, a reset signal is inputted to a reset input terminal R of the flip-flop (FF) 100 in the drive circuit 17*e*. This causes a Q output of the flip-flop 100 to be at a Low level. Accordingly, a gate-source electric charge of the switching element Q2 is extracted, so that the switching element Q2 is turned OFF immediately.

While the switching element Q2 is OFF, an electromagnetic energy stored in the inductor L2 is released to the output capacitor C2 via the diode D2. At this time, since the voltage across the inductor L2 is clamped by the voltage Vc2 of the output capacitor C2, a current i of the inductor L2 decreases at a substantially constant inclination di/dt (≈−Vc2/L2).

During a period in which the current i is flowing through the inductor L2, a voltage corresponding to the inclination of the current i of the inductor L2 is generated in the secondary winding n2 of the inductor L2. This voltage disappears when the current i of the inductor L2 finishes flowing. The ZCD detection circuit 7 detects this timing.

The ZCD detection circuit 7 includes the comparator 70 for zero cross detection. The voltage generated in the secondary winding n2 of the inductor L2 is connected to a negative input terminal of the comparator 70. The reference voltage Vref for zero cross detection generated in the reference voltage generator 71 is applied to a positive input terminal of the comparator 70. When the voltage of the secondary winding n2 disappears, an output of the comparator 70 turns to a High level, and a set pulse is supplied to a set input terminal S of the flip-flop 100 in the drive circuit 17*e*. Consequently, the Q output of the flip-flop 100 turns to a High level, and a gate signal of the switching element Q2 is applied so as to turn ON the switching element Q2.

By repeating such operations, the inductor current achieves a waveform that has a constant peak value and turns back up at a point of substantially zero. At this time, the output voltage Vout is equal to the voltage Vc2 across the output capacitor C2, and the output current Iout has a value of an average of the inductor current, namely, about a half of the peak current value.

An increase in the output voltage Vout automatically extends an ON time of the switching element Q2 and shortens an OFF time thereof. A decrease in the output voltage Vout automatically shortens the ON time of the switching element Q2 and extends the OFF time thereof. Therefore, it is possible to maintain constant current properties regardless of the voltage characteristics of the load (LED unit 13).

Now, as mentioned earlier in the background art section, since the components constituting the step-down chopper circuit 11*e* have a delay time, there occurs a delay time td0 from the timing of detecting a current peak before the switching OFF.

Figure 15:
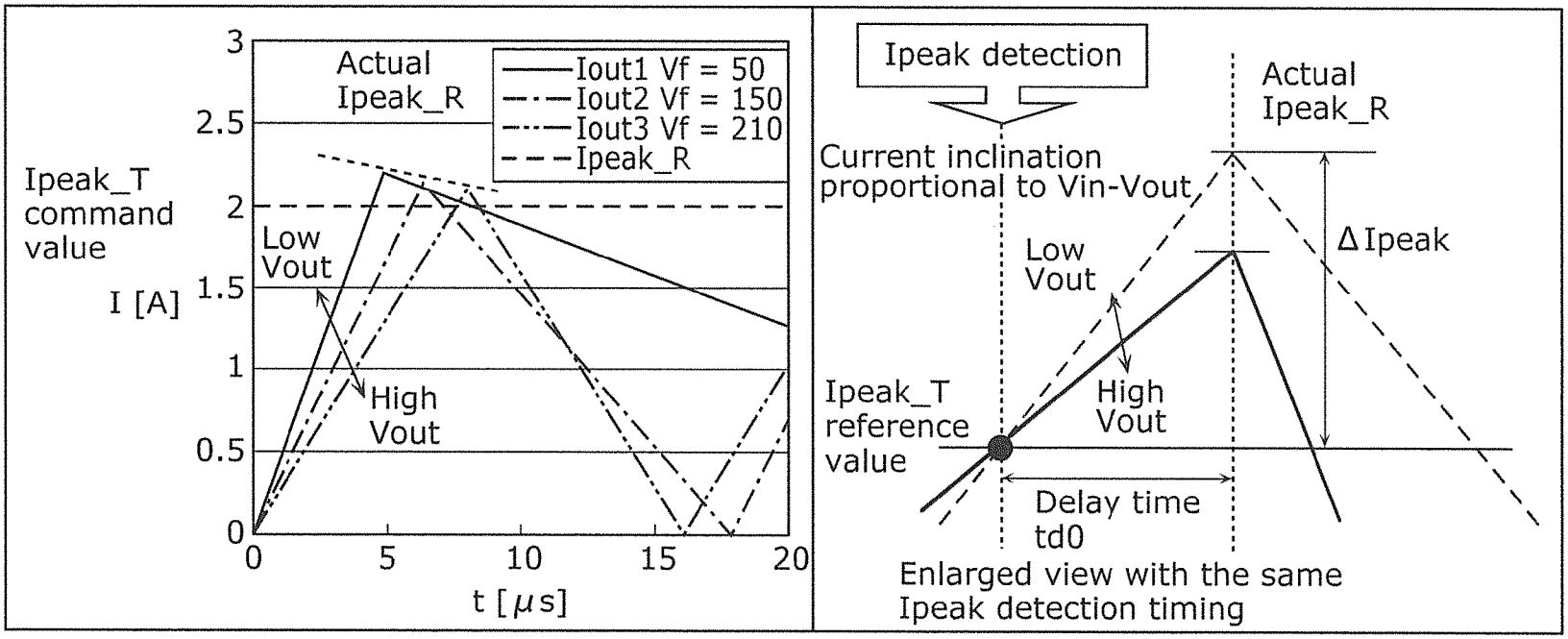
FIG. 15 PRIOR ART
FIG. 15 illustrates variations in peak value of a current flowing through an inductor included in a lighting device of a background art.

As FIG. 15 illustrates, due to such a delay time td0, an actual peak value Ipeak_R of the current IL2 flowing through the inductor L2 is greater than the current peak target value Ipeak_T (current command value). FIG. 15 illustrates variations in actual current peak value Ipeak_R of a current flowing through the inductor L2 (the inductor current IL2) in a lighting device of a background art. A section on the left in FIG. 15 illustrates various exemplary current peak values Ipeak_R, and a section on the right in FIG. 15 illustrates an enlarged view of a waveform of the inductor current IL2 near the current peak value Ipeak_R. As can be understood from the formula below, with a decrease in the output voltage Vout of the step-down chopper circuit 11*e*, the difference between the actual peak current value Ipeak_R and the current peak target value Ipeak_T: Δipeak=Ipeak_R−Ipeak_T increases.

$$\Delta ipeak = Ipeak_R - Ipeak_T = di/dt \times td0 = (Vc3 - Vout)/L \times td0$$

Figure 16:
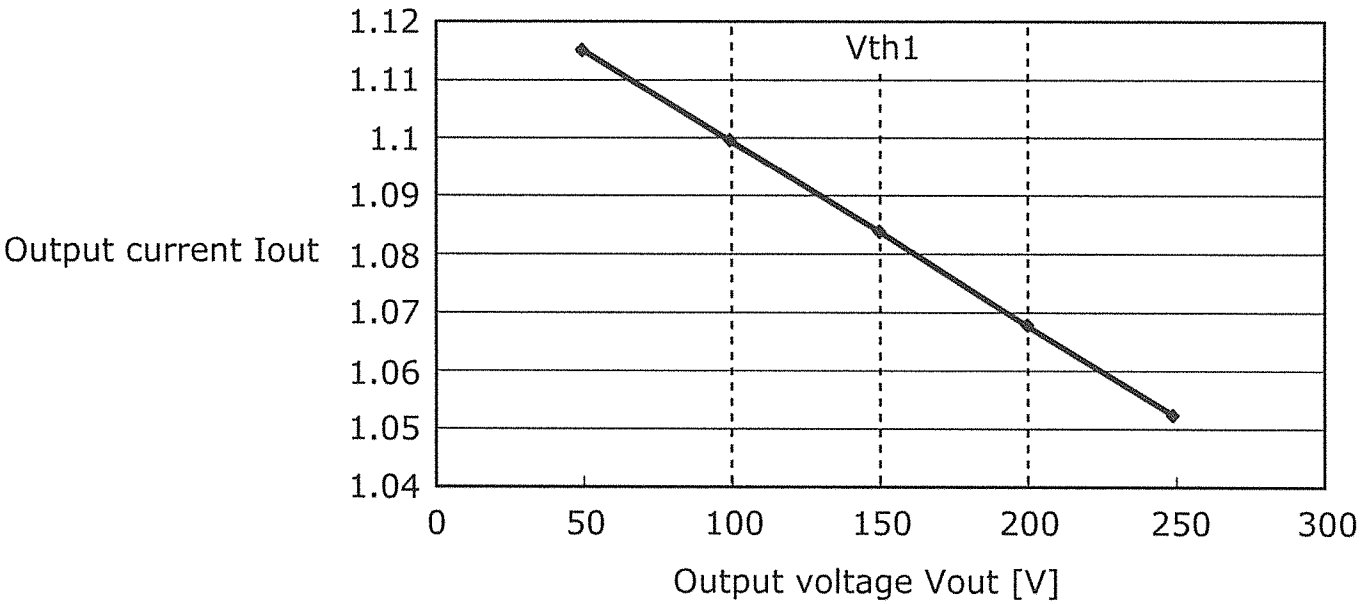
FIG. 16 PRIOR ART
FIG. 16 illustrates output voltage-current characteristics in the lighting device of the background art.

This is because, even if the delay time td0 is constant, the inclination of the current of the inductor L2 during the period where the switching element Q2 is ON is di/dt≈(Vc3−Vout)/L2, i.e., and the inclination di/dt varies depending on the output voltage Vout. Accordingly, when the step-down chopper circuit 11*e* is operated merely by the BCM control and the peak current control, the output voltage-current characteristics do not achieve perfect constant current characteristics but achieve characteristics as in a background art illustrated in FIG. 16 in which the output current increases with a decrease in the output voltage Vout. FIG. 16 illustrates the output voltage-current characteristics in a lighting device of a background art. The output voltage-current characteristics illustrated here are as follows.

$$Iout = Ipeak_R/2 = (\Delta ipeak + Ipeak_T)/2 = (Vc3 - Vout)/L \times td0/2 + Ipeak_T/2$$

In an actual lighting device having such characteristics, when there is an individual difference in forward voltage (namely, output voltage Vout) among loads (LED unit 13) to be connected, the output current varies individually, resulting in variations in light output. Also, when different types of loads having the same current rating and different voltage ratings are connected or when a plurality of the same loads are connected in series in a circuit, it might not be able to achieve desired light output because the difference in output voltage causes the output current to deviate from a rated range.

For example, when a plurality of LED modules with a forward voltage (namely, a voltage Vout) rated at 100 V are connected in series to a lighting device having the output characteristics shown in FIG. 16, the output current is 1.10 A in the case where the number of the series-connected loads is one (Vout=100 V), and the output current is 1.07 A in the case where the number thereof is two (Vout=200 V). The output current varies by 30 mA. Accordingly, even when the same LED modules are used, the light output per LED module varies depending on the number of the LED modules connected in series. Incidentally, the condition for calculating the above-noted output current is Vc3=420 V, inductor L=800 uH, td0=500 nS and Ipeak_T=2 A.

Thus, in Embodiment 5, the correction circuit 16*e* is included in the control circuit 12*e*. The correction circuit 16*e* corrects the current command value Iref_i provided from the dimming control circuit 18*e*, when the output voltage Vout detected by the voltage detection circuit 15*e* is less than or equal to the first threshold value. In this way, the difference Δipeak between the actual peak current value Ipeak_R of the inductor current IL2 and the current peak target value Ipeak_T is kept constant regardless of the output voltage Vout. In Embodiment 5, it is controlled such that, in the relationship between the output voltage Vout detected by the voltage detection circuit 15*e* and the peak value of a current flowing through the inductor L2, the current value has peaks that are substantially the same in value at at least two different output voltages Vout.

The correction circuit 16*e* receives the current command value Iref_i from the dimming control circuit 18*e* as input, and outputs the current command value Iref_o as output. More specifically, when the output voltage Vout detected by the voltage detection circuit 15*e* is greater than the first threshold value Vth1, the correction circuit 16*e* outputs the current command value Iref_i from the dimming control circuit 18*e* without change as the current command value Iref_o. On the other hand, when the output voltage Vout is less than or equal to the first threshold value Vth1, the correction circuit 16*e* attenuates (divides voltage of) the current command value Iref_i from the dimming control circuit 18*e*. The correction circuit 16*e* then outputs the current command value Iref_o where Iref_o<Iref_i.

With such an operation, a difference is reduced which is caused due to the output voltage Vout of the actual peak current value Ipeak_R.

Figure 17:
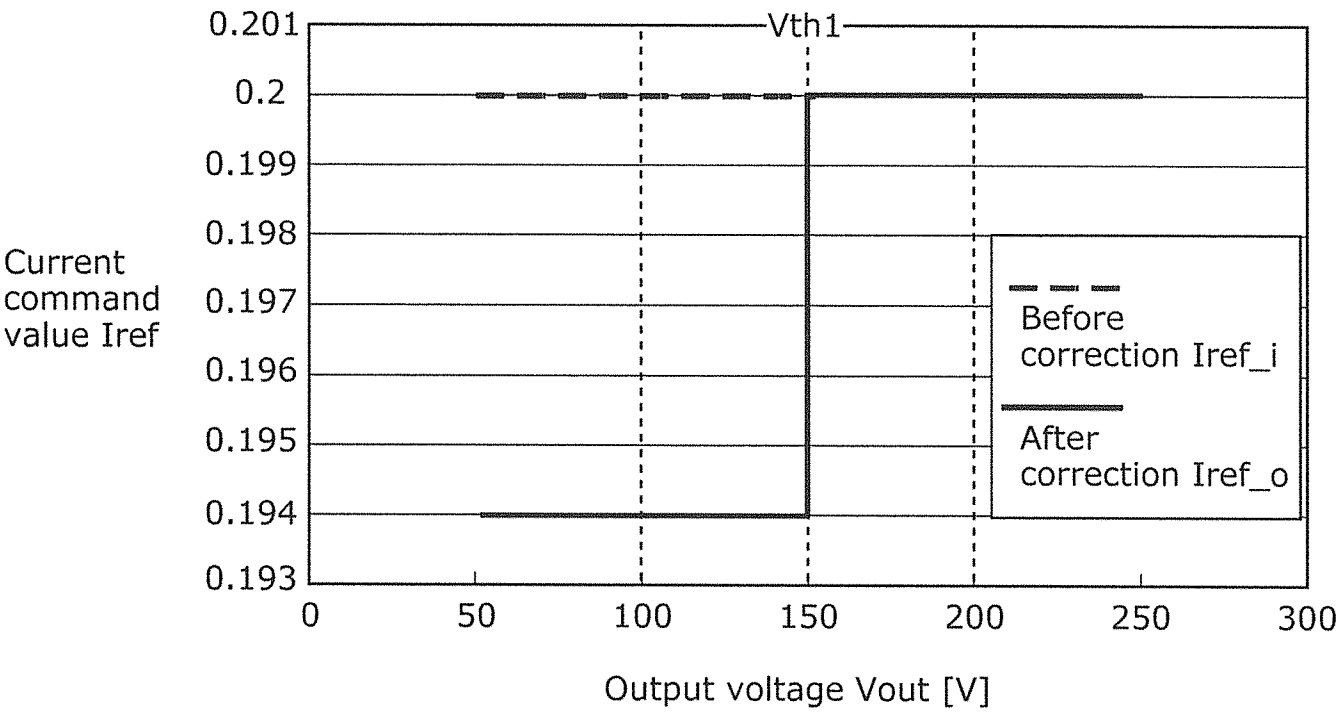
FIG. 17 illustrates a relationship between an output voltage and a current command value in the lighting device according to Embodiment 5.
Figure 18:
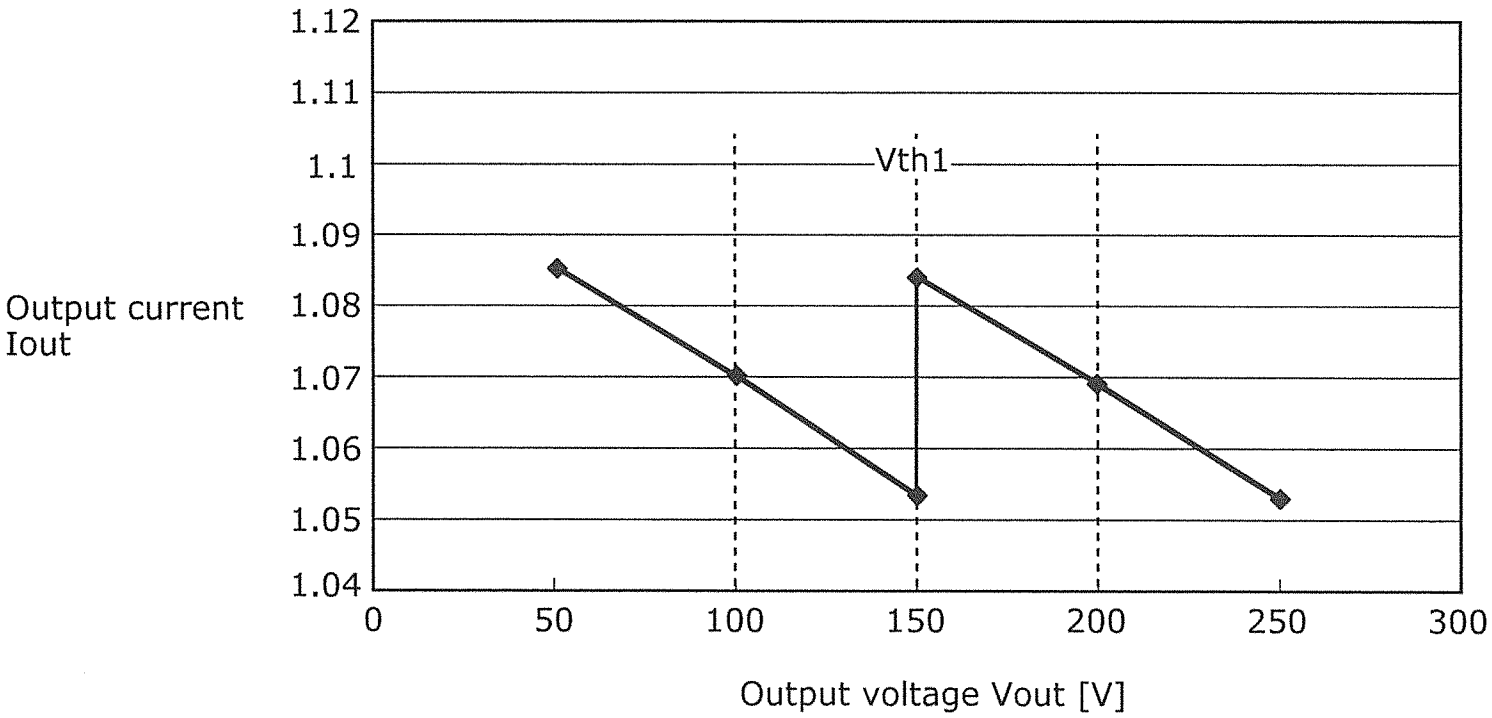
FIG. 18 illustrates output voltage-current characteristics in the lighting device according to Embodiment 5.

FIG. 17 illustrates the relationship between the output voltage Vout and the current command value Iref (Iref_i, Iref_o) when Vc3=420 V, Td0=500 nS, inductor L=800 uH, and Ipeak_T=2 A. The current command value Iref_o outputted from the correction circuit 16*e* is obtained by correcting the current command value Iref_i=0.2 in a step like manner such that Iref_o=0.194 where Vout<150 V, With such a correction of the current command value, as FIG. 18 illustrates, the difference in actual peak current value Ipeak_R due to the output voltage Vout can be reduced. FIG. 18 illustrates the output voltage-current characteristics in the lighting device 10*e* according to Embodiment 5. As seen from the comparison between FIG. 16 in the background art and FIG. 18, the lighting device 10*e* according to Embodiment 5 have the output voltage-current characteristics which have small variations caused due to the voltage Vout.

When LED modules with a forward voltage Vout rated at 100 V are connected to the lighting device having the output voltage-current characteristics illustrated in FIG. 18, the output current is 1.070 A in the case where the number of the series-connected loads is one (Vout=100 V). The output current is 1.070 A also in the case where the number thereof is two (Vout=200 V). In this way, the output current does not vary. The condition for calculating the above-noted output current is Vc3=420 V, inductor L=800 uH, Td0=500 nS, and Ipeak_T=2 A.

In such a way, according to Embodiment 5, the output current can be kept substantially the same even (output voltage dependency of the output current is reduced) when the number of the series connected LEDs as the LED unit 13 is changed, by correcting the current command value Iref_i from the dimming control circuit 18*e*.

In order to obtain effective functions of the correction circuit 16*e* according to Embodiment 5, it is set such that the first threshold value Vth1 falls between the forward voltages Vr1 and Vr2 of the two LED units 13 having different forward voltages among the LED units 13 to be connected to the lighting device 10*e*. For example, Vth1 is set such that a relation of Vr1<Vth1<Vr2 is satisfied. The output current rapidly changes near the output voltage at which the comparator 90 in the correction circuit 16*e* is switched. Hence, it may be that the first threshold value Vth1 is set to the output voltage that is not normally adopted. For example, the first threshold value Vth1 may be set to an intermediate value of the output voltage of the loads (LED units 13) to be connected. In the above calculation example, the output voltage is assumed to be 100 V or 200 V. Hence, 150V that is the intermediate value is selected as the first threshold value Vth1. The first threshold value Vth1 may have a predetermined hysteresis value.

The step-down chopper circuit 11*e* that can achieve the present embodiment does not have to be the circuit illustrated in FIG. 13 but may be a converter in which the inclination of a current flowing through the inductor varies according to the output voltage when the switching element Q2 is ON. In other words, the step-down chopper circuit according to Embodiment 5 is appropriate as long as it is of a type in which a current flows from the positive electrode of the smoothing capacitor C3 via the output capacitor C2 and the inductor L2 to the negative electrode of the smoothing capacitor C3. It should be noted that details, for example, a positive and a negative of the logic in the detection circuits sometimes have to be changed partially according to the circuit configuration to be adopted.

As described above, in Embodiment 5, when the output voltage detected by the voltage detection circuit 15*e* is less than or equal to the first threshold value, the correction circuit 16*e* corrects the current command value Iref_i from the dimming control circuit 18*e*. This makes it possible to achieve the lighting device 10*e* that keeps the output current Iout constant regardless of the output voltage Vout (the lighting device 10*e* in which the dependency of the output current Iout on the output voltage Vout is reduced). Thus, even when loads (LED units 13) with different voltage ratings are connected or when the number of series-connected LEDs as loads is changed, a desired light output can be obtained.

Embodiment 6

Next, a lighting device according to Embodiment 6 of the present invention will be described.

The lighting device according to Embodiment 6 is different from that in Embodiment 5 in that the correction circuit changes the relationship between the output voltage Vout and the current command value Iref_o at plural switching points (that is, threshold values). Hereinafter, the following description of Embodiment 6 will be directed only to the differences (correction circuit) from Embodiment 5.

Figure 19:
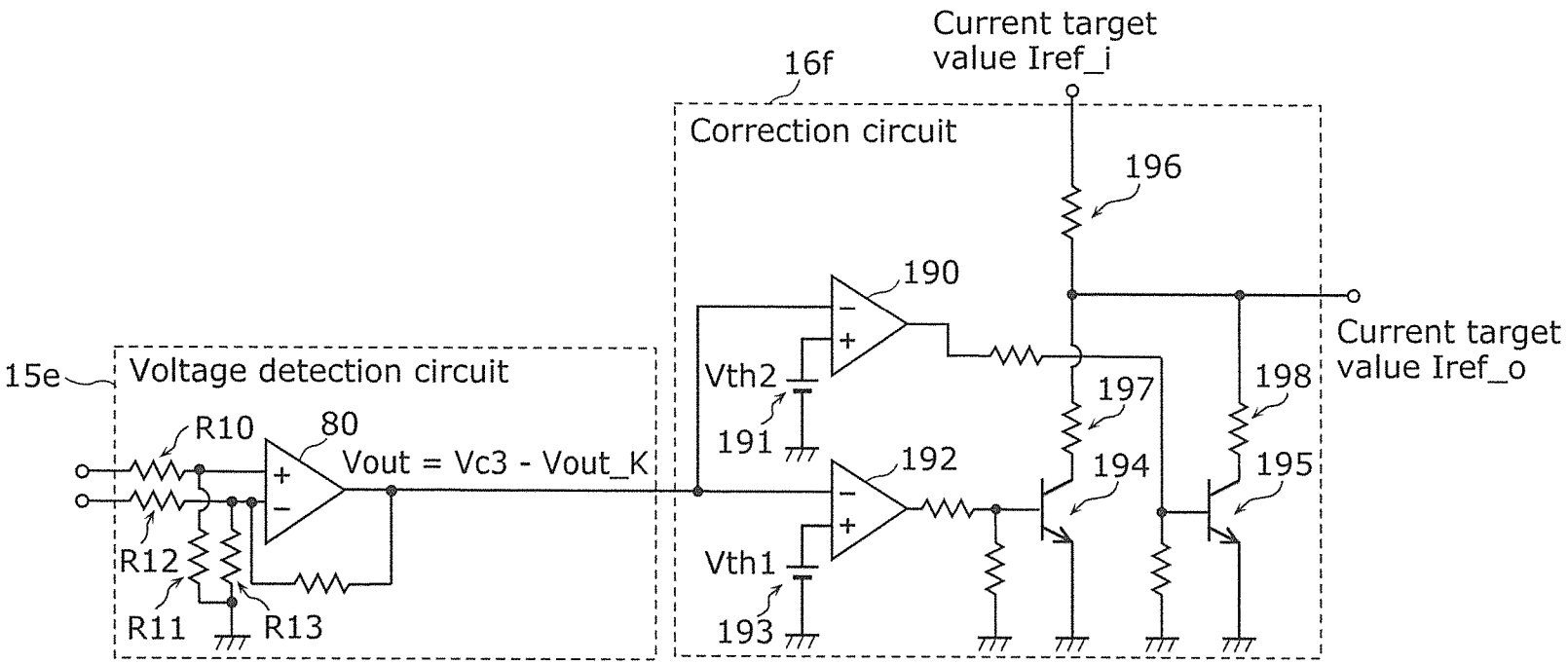
FIG. 19 is a detailed circuit diagram of a correction circuit according to Embodiment 6.

FIG. 19 is a detailed circuit diagram of a correction circuit 16*f* according to Embodiment 5. As FIG. 19 illustrates, the correction circuit 16*f* includes: two comparators 190 and 192, two reference voltage generators 191 and 193; two transistors 194 and 195, and resistors 196 to 198; and the like. The correction circuit 16*f* corresponds to two sets of the correction circuit 16*e* according to Embodiment 5 (with different reference voltages). The reference voltages generated by the two reference voltage generators 191 and 193 (a first threshold value Vth1 and a second threshold value Vth2) are set so as to satisfy Vth2<Vth1.

In the correction circuit 16*f* having such a configuration, the output voltage Vout from the voltage detection circuit 15*e* is compared by the comparators 190 and 192 with the second threshold value Vth2 and the first threshold value Vth1. The transistors 194 and 195 are turned ON and OFF according to the comparison results. The current command value Iref_i is divided according to a first division ratio or a second division ratio, or output as the current command value Iref_o without being divided.

More specifically, when the output voltage Vout from the voltage detection circuit 15*e* is greater than the first threshold value Vth1 (Vth1<Vout), the comparators 192 and 190 output Low level signals, and the two transistors 194 and 195 are turned OFF. As a result, the current command value Iref_i from the dimming control circuit 18*e* is outputted as the current command value Iref_o without being divided.

When the output voltage Vout from the voltage detection circuit 15*e* is greater than the second threshold value Vth2 and less than or equal to the first threshold value Vth1 (Vth2<Vout Vth1), the comparator 192 outputs a High level signal and the comparator 190 outputs a Low level signal. As a result, only the transistor 194 is turned ON out of the two transistors 194 and 195. The current command value Iref_i from the dimming control circuit 18*e* is divided according to the first division ratio determined by the resistors 196 and 197, and is outputted as the current command value Iref_o.

When the output voltage Vout from the voltage detection circuit 15*e* is less than or equal to the second threshold value Vth2 (Vout Vth2), the comparators 192 and 190 outputs high level signals, and the two transistors 194 and 195 are turned ON. As a result, the current command value Iref_i from the dimming control circuit 18*e* is divided according to the second division ratio (<first division ratio) determined by the resistor 196 and combined parallel resistance of the resistors 197, and 198. The obtained value is outputted as the current command value Iref_o.

Figure 20:
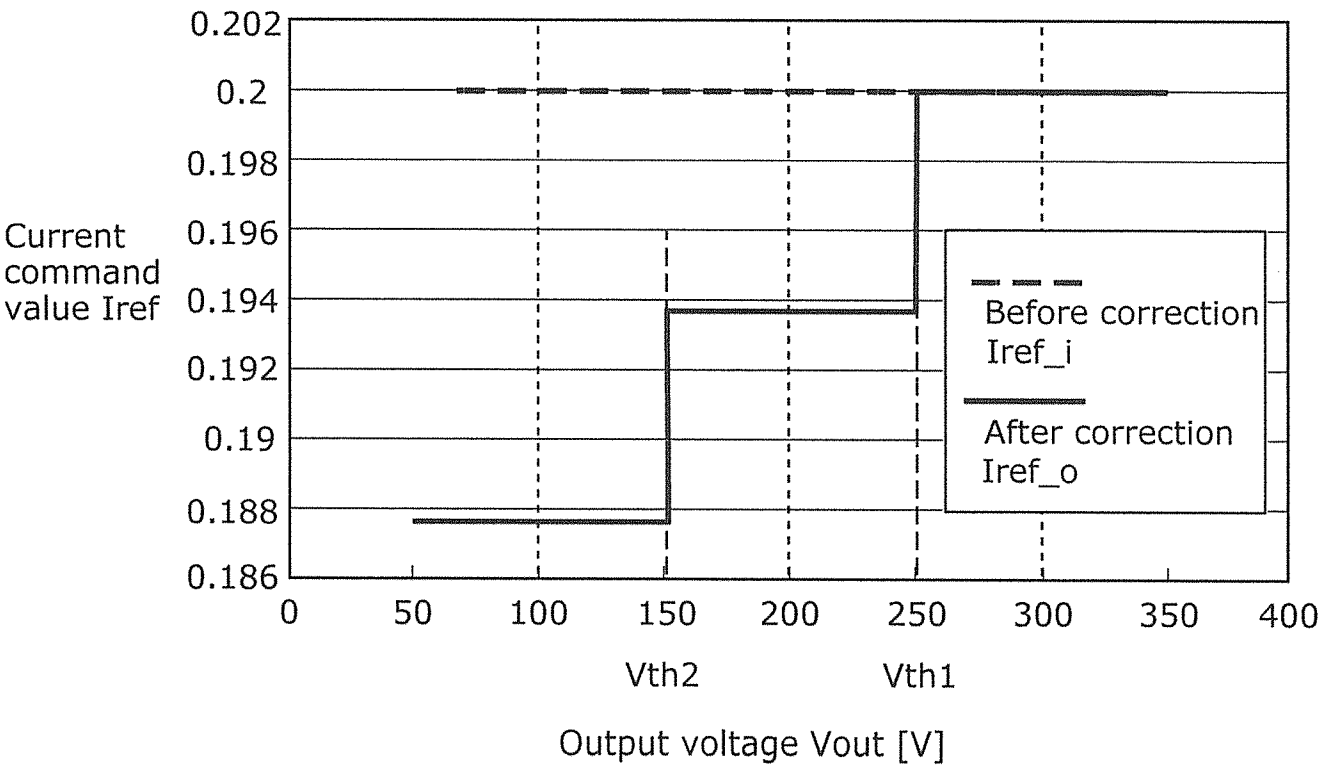
FIG. 20 illustrates a relationship between an output voltage and a current command value in a lighting device according to Embodiment 6.
Figure 21:
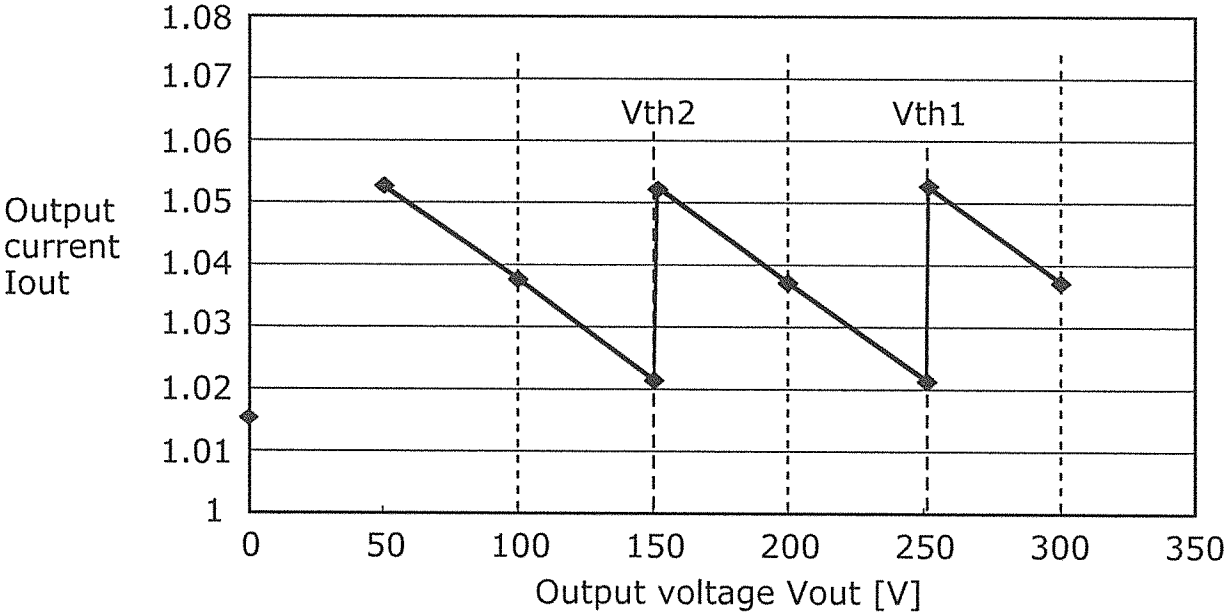
FIG. 21 illustrates output voltage-current characteristics in the lighting device according to Embodiment 6.

With such an operation, the correction circuit 16*f* can change the current command value Iref_o at two points of Vout (the first threshold value Vth1 and the second threshold Vth2) as illustrated in FIG. 20. This results in the output voltage-current characteristics as illustrated in FIG. 21. FIG. 20 illustrates an example of the relationship between the output voltage Vout and the current command value Iref (Iref_i and Iref_o) of the lighting device according to Embodiment 6. FIG. 21 illustrates the output voltage-current characteristics in the lighting device according to Embodiment 6.

As seen from the comparison between FIG. 16 in the background art and FIG. 21, the lighting device according to Embodiment 6 can further reduce the difference in the actual peak current value Ipeak_R due to the output voltage Vout. By making the correction circuit 16*f* have plural voltage switching points in such a manner, a larger number of loads (the LED units 13) having different rated voltages can be connected to the lighting device (in other words, the lighting device can supply substantially constant output current).

For example, it is possible to output substantially the same current to the LED unit 13 when Vout=100 V, 200 V, and 300 V with the characteristics illustrated in FIG. 21.

In order to obtain effective functions of the correction circuit 16*f* according to Embodiment 6, it is set such that the first threshold value Vth1 and the second threshold value Vth2 fall between the forward voltages Vr1 and Vr2 of two LED units 13 having different forward voltages among the LED units 13 to be connected to the lighting device. For example, the values are preferably set to satisfy Vr1<Vth2<Vth1<Vr2.

Embodiment 7

Next, a lighting device according to Embodiment 7 of the present invention will be described.

The lighting device according to Embodiment 7 is different from that in Embodiment 5 in that a correction circuit detects a cathode voltage Vout_K that varies according to an output voltage Vout, and continuously corrects the current command value Iref according to the cathode voltage Vout_k. With this, it is possible to achieve a lighting device that reliably keeps the output current Iout constant regardless of the output voltage Vout. Hence, the lighting device according to Embodiment 7 is obtained by partially changing the voltage detection circuit 15*e* and the correction circuit 16*e* in the lighting device 10*e* according to Embodiment 5. Hereinafter, the following description of Embodiment 7 will be directed only to the differences (the voltage detection circuit and the correction circuit) from Embodiment 5.

Figure 22:
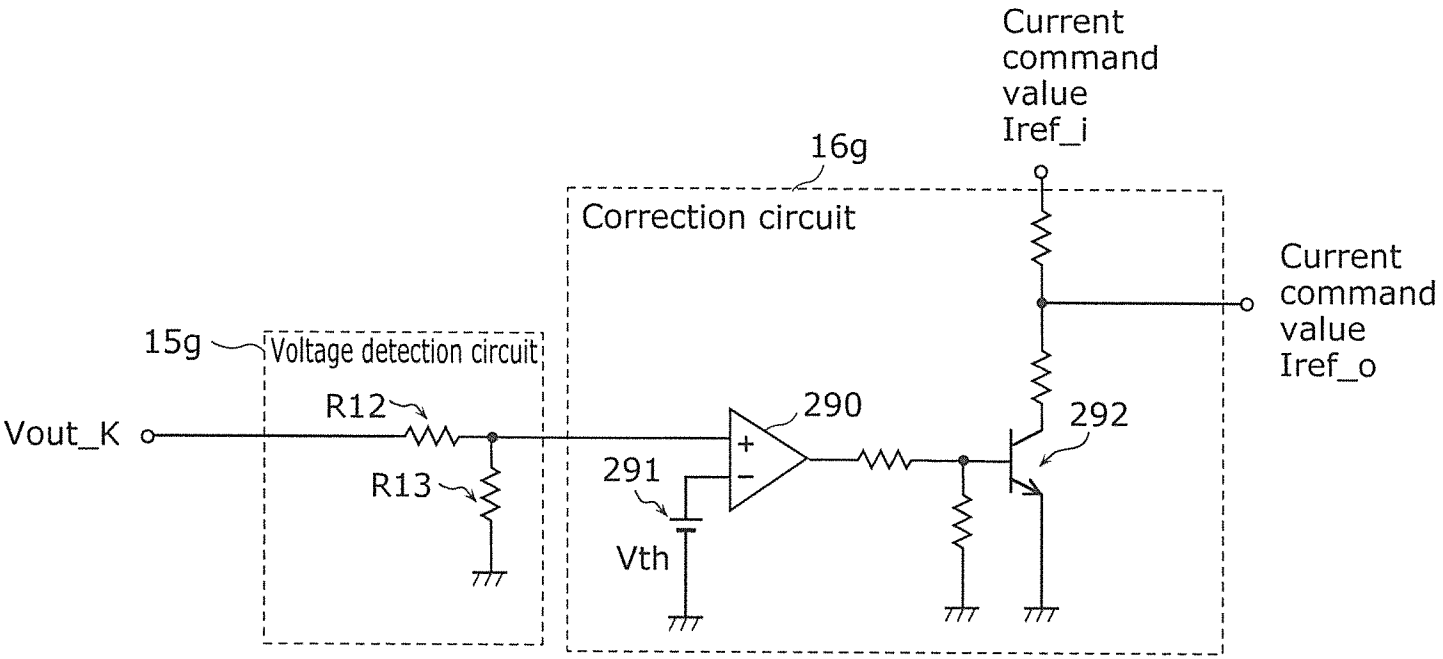
FIG. 22 is a detailed circuit diagram of a voltage detection circuit and a correction circuit according to Embodiment 7.

FIG. 22 is a detailed circuit diagram of a voltage detection circuit 15*g* and a correction circuit 16*g* according to Embodiment 7.

The voltage detection circuit 15*g* divides the cathode voltage Vout_K with the resistors R12 and R13, and outputs the obtained divided voltage to the correction circuit 16*g*. During the period in which the switching element Q2 is ON, the cathode voltage Vout_K is substantially equal to the voltage VL across the inductor L2. This is because the ON resistance of the switching element Q2 and the resistor R2 are so small as to be negligible. In Embodiment 7, the voltage detection circuit 15*g* detects the cathode voltage Vout_K, thereby detecting the voltage VL across the inductor L2 during the period in which the switching element Q2 is ON.

The correction circuit 16*g* corrects the current command value Iref_i such that the peak value of a current flowing through the inductor L2 is kept constant regardless of the magnitude of the voltage detected by the voltage detection circuit 15*g*. More specifically, the correction circuit 16*g* continuously corrects the current command value Iref according to the voltage detected by the voltage detection circuit 15*g* (here, the cathode voltage Vout_K). For that purpose, the correction circuit 16*g* includes a transconductance amplifier 290, a reference voltage generator 291 that generates a reference voltage (a threshold voltage Vth), a transistor 292, and the like.

The voltage detection circuit 15*g* and the correction circuit 16*g* configured as above operate as below.

The voltage detection circuit 15*g* outputs the voltage obtained by dividing the cathode voltage Vout_K to the correction circuit 16*g*.

In the correction circuit 16*g*, the transconductance amplifier 290 outputs, to the base of the transistor 292, a current corresponding to a difference between the voltage from the voltage detection circuit 15*g* and the threshold voltage Vth generated by the reference voltage generator 291. The current command value Iref_o after correction is equal to a value obtained by dividing the input current command value Iref_i according to the resistors illustrated and a collector current of the transistor 292 (in other words, on-resistance of the transistor 292).

With the voltage detection circuit 15*g* and the correction circuit 16*g*, the collector current of the transistor 292 increases with an increase in the cathode voltage Vout_K, so that the current command value Iref_o after correction continuously decreases. In other words, according to the above described relationship between the output voltage Vout and the cathode voltage Vout_K (Vout=Vc3−Vout_K), the generated current command value Ifref_o decreases as the output voltage Vout decreases.

The threshold voltage Vth generated by the reference voltage generator 291 is set as an offset value which appropriately relates the cathode voltage Vout_K (or the output voltage Vout) and the current command value Iref_o after correction.

Figure 23:
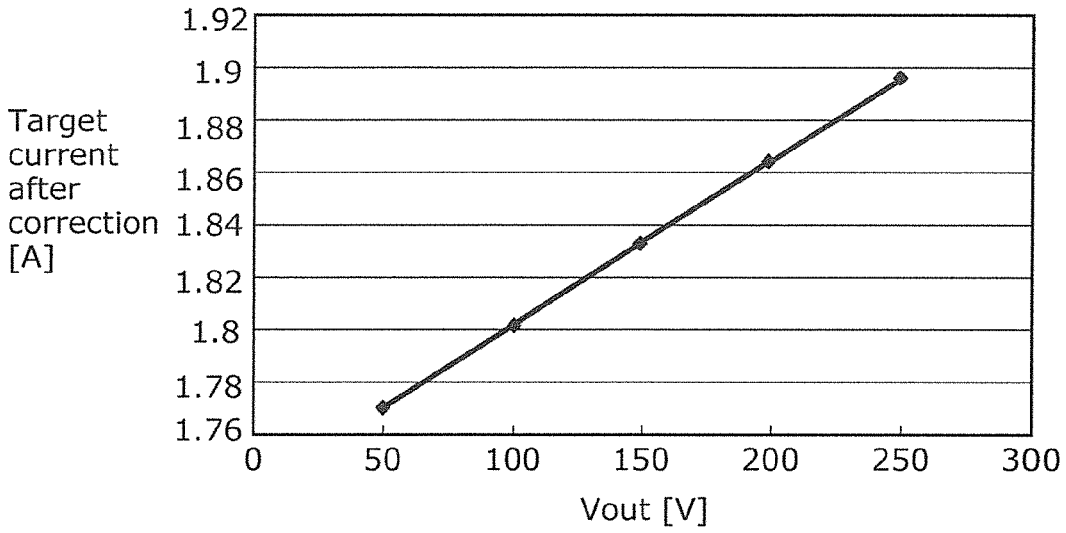
FIG. 23 illustrates a relationship between an output voltage and a current command value in a lighting device according to Embodiment 7.
Figure 24:
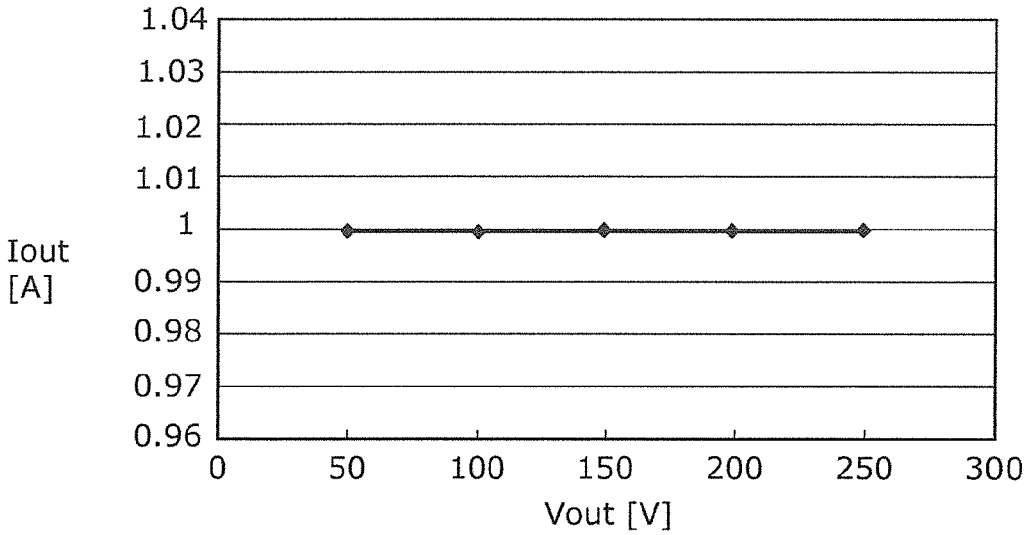
FIG. 24 illustrates output voltage-current characteristics in the lighting device according to Embodiment 7.

The experimental results obtained by the voltage detection circuit 15*g* and the correction circuit 16*g* are shown in FIG. 23 (current command value correction) and FIG. 24 (voltage-current characteristics). In other words, FIG. 23 illustrates an example of the relationship between the output voltage Vout and the current command value Iref_o after correction of the lighting device according to Embodiment 7. FIG. 24 illustrates the output voltage-current characteristics in the lighting device according to Embodiment 7.

As FIG. 23 illustrates, in Embodiment 7, the current command value Iref_o after correction continuously varies in such a manner that the current command value Iref_o after correction increases as the output voltage Vout of the lighting device increases. Moreover, as seen from the comparison between FIG. 24 and the lighting device of a background art in FIG. 16, the output current Iout is constant regardless of the output voltage Vout.

In this manner, according to the lighting device in Embodiment 7, the current command value Iref_i from the dimming control circuit 18*e* is corrected such that the current flowing through the inductor L2 has a constant peak value regardless of the voltage detected by the voltage detection circuit 15*g*. As a result, constant output current Iout is ensured regardless of the output voltage Vout.

Embodiment 8

Next, a lighting device according to Embodiment 8 of the present invention will be described.

Embodiment 8 is different from Embodiments 5 to 7 in that plural step-down chopper circuits, control circuits, solid-state light-emitting elements (here, LED units) are included.

Figure 25:
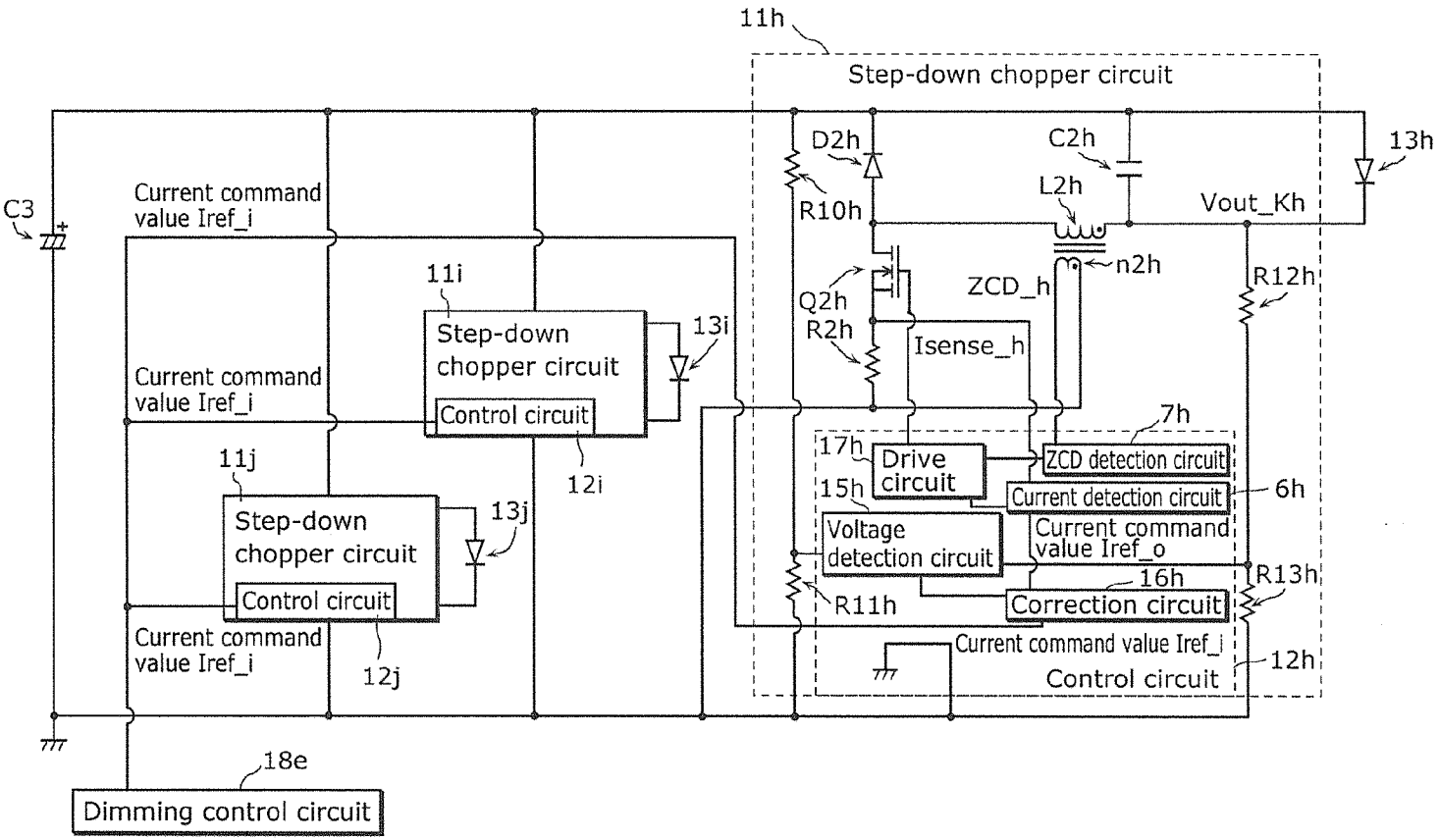
FIG. 25 is a circuit diagram of a lighting device according to Embodiment 8.

FIG. 25 is a circuit diagram of a lighting device according to Embodiment 8.

Here, for example, a description is given using a circuit of a lighting device including three step-down chopper circuits 11*h* to 11*j*. The lighting device includes step-down chopper circuits 11*h* to 11*j* for stepping down a DC voltage of the smoothing capacitor C3 serving as a common DC power source and supplying a DC current to LED units 13*h* to 13*j* serving as loads, and control circuits 12*h* to 12*j*.

Each of the step-down chopper circuits 11*h* to 11*j* has a circuit configuration similar to that of the step-down chopper circuit 11*e* in Embodiment 5. For example, the step-down chopper circuit 11*h* includes an inductor L2*h*, a switching element Q2*h*, a diode D2*h* and an output capacitor C2*h*.

Each of the control circuits 12*h* to 12*j* has a circuit configuration similar to the control circuit 12*e* in Embodiment 5. For example, the control circuit 12*h* includes a current comparison circuit 6*h*, a ZCD detection circuit 7*h*, a voltage detection circuit 15*h*, a correction circuit 16*h* and a drive circuit 17*h*. A common current command value Iref_i is inputted from a dimming control circuit 18*e* to the three control circuits 12*h* to 12*j*.

Each of the step-down chopper circuits 11*h* to 11*j* and its corresponding one of the control circuits 12*h* to 12*j* operate independently of each other and similarly to Embodiment 5. For example, as for the step-down chopper circuit 11*h* and the control circuit 12*h*, when the output voltage detected by the voltage detection circuit 15*h* is less than or equal to the first threshold value, the correction circuit 16*h* corrects the current command value Iref_i. In this way, the peak value of a current flowing through the inductor L2 is kept constant regardless of the output voltage (or the variation range is reduced). As a result, it is possible to achieve a lighting device that keeps an output current constant regardless of the output voltage (or the variation range of the output current is reduced).

Figure 26:
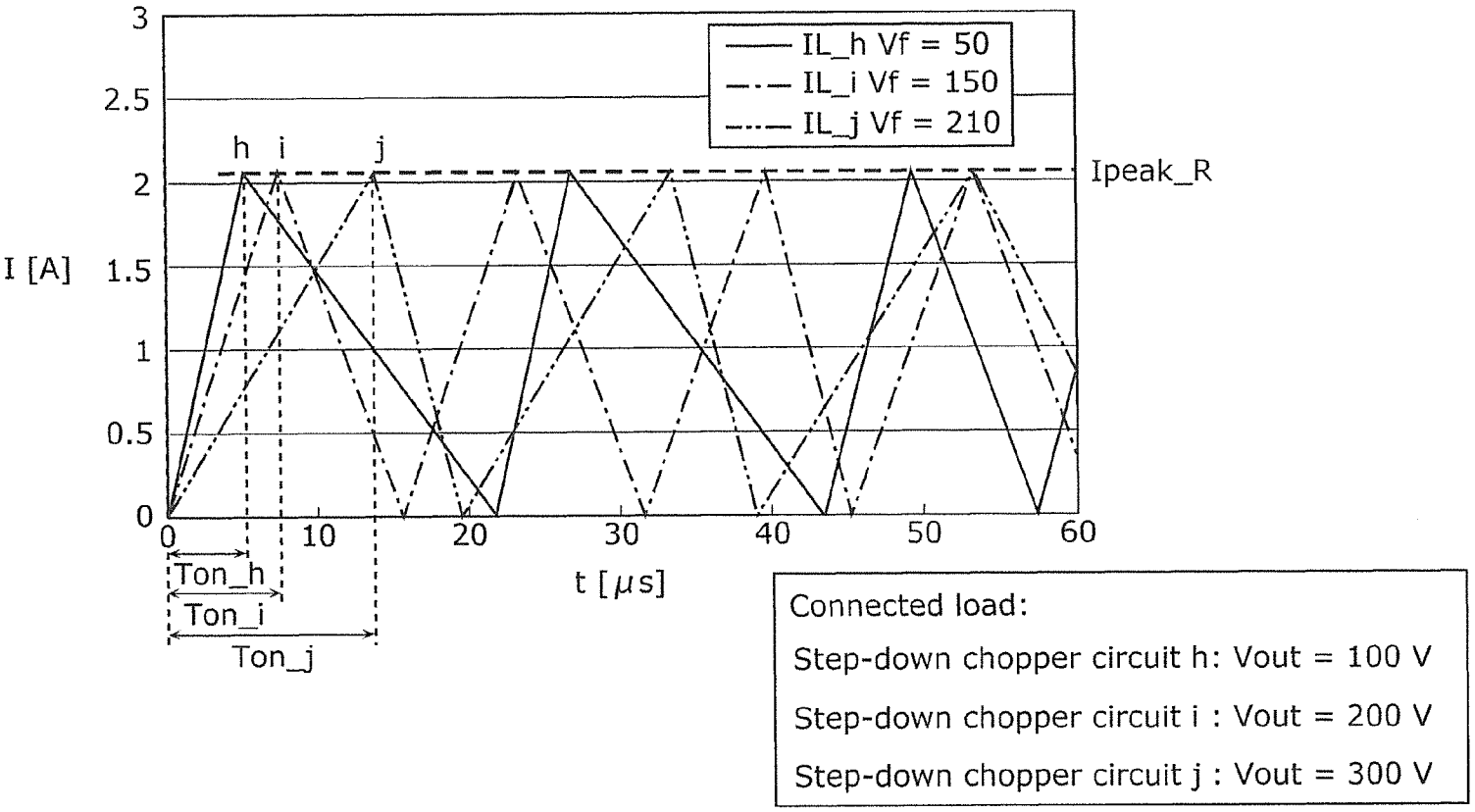
FIG. 26 illustrates exemplary waveforms of currents flowing through inductors in respective buck converters in the lighting device according to Embodiment 8.

FIG. 26 illustrates exemplary waveforms of currents IL_h to IL_j flowing through the inductors in the respective step-down chopper circuit 11*h* to 11*j*. The correction circuit included in each of the control circuits 12*h* to 12*j* is similar to the correction circuit 16*f* in Embodiment 6. The three step-down chopper circuits 11*h* to 11*j* are connected with the following loads (LED units 13*h* to 13*j*) having different rated voltages. In other words, the LED unit 13*h* connected to the step-down chopper circuit 11*h* has a rated voltage Vout_h=100 V, the LED unit 13*i* connected to the step-down chopper circuit 11*i* has a rated voltage Vout_i=200 V, and the LED unit 13*j* connected to the step-down chopper circuit 11*j* has a rated voltage Vout_j=300 V.

As becomes clear from the exemplary waveforms in FIG. 26, although ON times Ton of the switching elements and current inclinations Δi are different among the step-down chopper circuits 11*h* to 11*j*, the target value Iref_i is corrected according to the output voltage Vout. With this, the current peak value Ipeak_R is kept substantially constant, so that the output current can be kept substantially constant.

In this way, according to Embodiment 8, it is possible to obtain a lighting device that has a constant output current regardless of the output voltage, by ensuring constant current properties of the output voltage-current characteristics at each output. Furthermore, even when LEDs with different rated voltages are connected to respective outputs, or when the number of LEDs connected in series is changed, a desired current can be passed, thereby obtaining a desired light output.

As described above, in Embodiment 8, it is possible to achieve a lighting device capable of ensuring a desired light output in each output and reducing the variations in light output among the entire light outputs.

It should be noted that, although the lighting device in Embodiment 8 includes three sets of the step-down chopper circuit and the control circuit of Embodiment 5, the lighting device may include less or greater number of sets of the step-down chopper circuit and the control circuit or may include the step-down chopper circuit and the control circuit of Embodiment 6 or 7.

Embodiment 9

Next, a luminaire according to Embodiment 9 of the present invention will be described.

Figure 27:
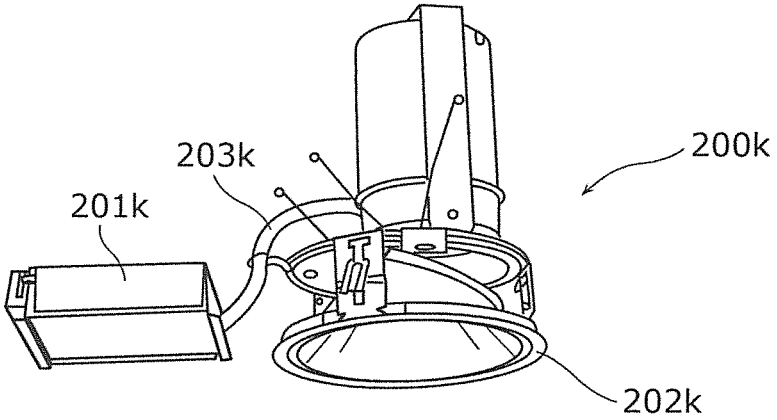
FIG. 27 illustrates an external appearance of an example of a luminaire according to Embodiment 9.
Figure 28:
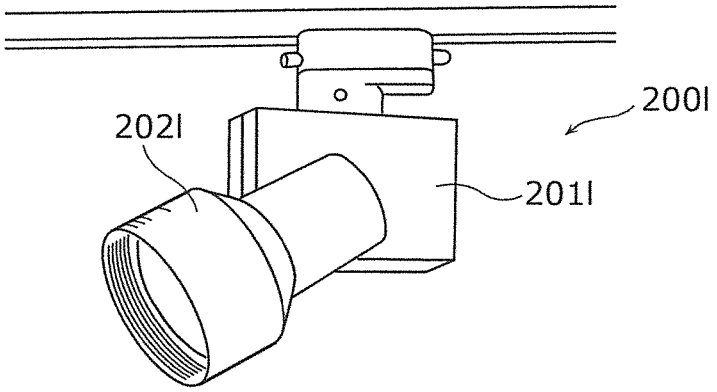
FIG. 28 illustrates an external appearance of another example of the luminaire according to Embodiment 9.
Figure 29:
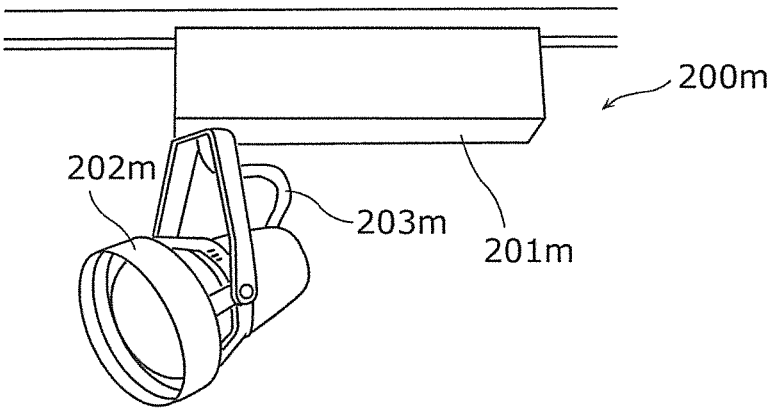
FIG. 29 illustrates an external appearance of another example of the luminaire according to Embodiment 9.

FIGS. 27 to 29 illustrate external appearances of luminaires 200*k* to 200*m* according to Embodiment 9.

FIG. 27 illustrates an example where the luminaire 200*k* is applied to a recessed light. FIG. 28 and FIG. 29 illustrate examples where the luminaires 200*l* and 200*m* are applied to spot lights.

The luminaires 200*k* to 200*m* illustrated in FIG. 27 to FIG. 29 respectively include circuit boxes 201*k* to 201*m* and lamps 202*k* to 202*m*. The luminaire 200*k* illustrated in FIG. 27 and the luminaire 200*m* illustrated in FIG. 29 further include wiring 203*k* and 203*m*, respectively.

Each of the circuit boxes 201*k* to 201*m* includes one of the lighting devices according to the above described embodiments. Each of the lamps 202*k* to 202*m* is provided thereon with an LED unit.

The wiring 203*k* is wiring for electrically connecting the circuit box 201*k* and the lamp 202*k*. The wiring 203*m* is wiring for electrically connecting the circuit box 201*m* and the lamp 202*m*.

In Embodiment 9, the above described lighting devices are used for the luminaires 200*k* to 200*m*, so that a current flowing through the LED unit has a desired current value. Hence, it is possible to reduce variations in light output of each luminaire when the luminaires 200*k* to 200*m* are installed in the same space.

Moreover, when each of the luminaires 200*k* to 200*m* includes a plurality of LED units, it is possible to reduce color unevenness among the LED units.

As described above, the lighting device according to the above described embodiments is a lighting device that is connected to a DC power source to supply a current to a solid-state light-emitting element. The lighting device includes: a DC/DC converter; and a control circuit. The DC/DC converter includes: a switching element that is connected to the DC power source and is turned ON and OFF; an inductor that is connected in series with the switching element, and through which the current from the DC power source flows when the switching element is ON; a diode that supplies, to the solid-state light-emitting element, the current released from the inductor; and a current detection circuit that detects a current flowing through the switching element and outputs a detected current value that is a value of the current detected. The control circuit includes: a drive circuit that turns the switching element ON and OFF; a voltage detection circuit that detects either one of a voltage across the solid-state light-emitting element and a voltage across the inductor, and outputs a detected voltage value that is a value of the voltage detected; and a correction circuit that corrects a timing at which the drive circuit turns OFF the switching element. When the drive circuit detects that the inductor has finished releasing energy, the drive circuit turns ON the switching element, and when the detected current value reaches a predetermined current command value, the drive circuit turns OFF the switching element, and the correction circuit corrects the timing at which the drive circuit turns OFF the switching element, based on the detected voltage value.

In this manner, the variations in output current that depends on the magnitude of the output voltage of the lighting device is reduced. Thus, even when there are variations in forward voltage or rated voltage among the solid-state light-emitting elements, a current defined by the current command value and having a value within a predetermined range is outputted to the solid-state light-emitting elements. Further, such a lighting device is realized by a relatively simple configuration. Accordingly, it is possible to achieve a lighting device which includes a switching power source circuit and which can stably light up solid-state light-emitting elements having different properties while reducing variations in light output of these elements with a simple configuration.

Moreover, in Embodiment 1, the correction circuit corrects the current command value based on the detected voltage value, so that the timing at which the drive circuit turns OFF the switching element is corrected.

With this, a constant current can be outputted to the solid-state light-emitting elements simply by adding a simple circuit to a portion of the control circuit that receives a signal from the current set circuit.

Moreover, in Embodiment 1, the correction circuit further corrects the current command value such that the corrected current command value has a positive correlation with the detected voltage value.

This allows more accurate control of the current output to the solid-state light-emitting elements.

Moreover, in Embodiment 2, the correction circuit corrects the current command value based on the detected voltage value, so that the timing at which the drive circuit turns OFF the switching element is corrected.

With this, a constant current can be outputted to the solid-state light-emitting elements simply by adding a simple circuit to a portion of the control circuit that receives a signal from the current set circuit.

Moreover, in Embodiment 2, the correction circuit corrects the current command value such that the corrected current command value has a negative correlation with the detected voltage value.

This allows more accurate control of the current output to the solid-state light-emitting elements.

Moreover, in Embodiment 3, a dimming control circuit which varies the current command value is further included.

With this, the solid-state light-emitting elements can be dimmed and lit up with a desired light output.

Moreover, in Embodiment 4, a plurality sets each including the DC/DC convertor and the control circuit are included.

With this, a same current defined by a common target current value is outputted to a plurality of solid-state light-emitting elements. Hence, it is possible to reduce variations in light output from respective solid-state light-emitting elements.

Furthermore, in Embodiment 5, the correction circuit 16*e* and the like correct a current command value such that, in the relationship between the voltage detected by the voltage detection circuit 15*e* or the like and the peak value of the current flowing through the inductor L2, the current value has peaks that are substantially the same in value at at least two different voltages.

In this manner, the variations in the output current that depends on the magnitude of the output voltage is reduced. Thus, even when there are variations in forward voltage or rated voltage among the solid-state light-emitting elements, a current defined by the current command value and having a value within a predetermined range is outputted to the solid-state light-emitting elements. Further, such constant current control is realized by a simple correction circuit. Accordingly, it is possible to achieve a lighting device which includes a switching power source circuit that is operated by the BCM control and the peak current control and which can stably light up solid-state light-emitting elements having different properties while reducing variations in light output of these elements with a simple configuration.

Moreover, in Embodiment 5, the correction circuit 16*e* corrects the current command value to a first correction value that is less than the current command value, when the output voltage detected by the voltage detection circuit 15*e* is less than or equal to the first threshold value. Accordingly, when the output voltage detected by the voltage detection circuit is less than or equal to the first threshold value, the current command value is corrected to the first correction value that is less than the current command value, thereby reducing variations in peak value of the current flowing through the inductor.

Moreover, in Embodiment 6, the correction circuit 16*f* further corrects the current command value to a second correction value that is less than the first correction value, when the output voltage detected by the voltage detection circuit 15*e* is less than or equal to the second threshold value that is less than the first threshold value. With this, a plurality of switching points (that is, threshold values) at which the relationship between the output value and the current command value is switched are provided, thereby further reducing variations in peak value of the current flowing through the inductor.

As for the thresholds, the first threshold value and the second threshold value fall between the values of the different forward voltages of two solid-state light-emitting elements among the solid-state light-emitting elements to be connected to the lighting device. Accordingly, the threshold values are set to be within a range of the forward voltages of the solid-state light-emitting elements to be connected to the lighting device. Hence, it is possible to reliably reduce variations in peak value of the current flowing through the inductor.

Moreover, in Embodiment 7, the correction circuit 16*g* corrects the current command value such that the peak value of the current flowing through the inductor L2 is constant regardless of the voltage detected by the voltage detection circuit 15*g*. Accordingly, the peak value of the current flowing through the inductor becomes constant regardless of the voltage detected by the voltage detection circuit 28. Hence, the output current is kept constant regardless of the output voltage.

Furthermore, in Embodiment 8, the lighting device is a device that lights up a plurality of solid-state light-emitting elements. The lighting device includes: the step-down chopper circuits 11*h* to 11*j* corresponding to a different one of the solid-state light-emitting elements; and the control circuits 12*h* to 12*j* that respectively control the step-down chopper circuits 11*h* to 11*j*. The lighting device further includes the dimming control circuit 18*e* that outputs a current command value determined according to a desired light output to the control circuits 12*h* to 12*j*. In this way, since the same output current defined by a common current command value is applied to the solid-state light-emitting elements, the magnitude of the light output evens out among the solid-state light-emitting elements. As a result, illumination is performed with reduced light output variations as a whole.

Furthermore, in Embodiment 9, the luminaire includes the lighting device according to one of the above described embodiments and one or more solid-state light-emitting elements.

Hence, it is possible to reduce variations in light output of each luminaire when a plurality of luminaires are installed in the same space. Moreover, when a luminaire includes a plurality of solid-state light-emitting elements, it is possible to reduce color unevenness among the solid-state light-emitting elements.

The above description has been directed to the lighting device and the luminaire according to the present invention, with reference to the embodiments. However, the present invention is not limited to these embodiments. As long as not departing from the purpose of the present invention, various modifications that are conceived by a person with ordinary skill in the art and made to the present embodiments and modes that are constructed by combining the structural components in different embodiments may also fall within one or more aspects of the present invention.

For example, although the lighting device in the above-described embodiments has used the LED element as the solid-state light-emitting element, the solid-state light-emitting element in the present invention may be any other solid-state light-emitting element such as an organic EL element.

Moreover, when the lighting devices in the above-described embodiments are applied to a plurality of luminaires, one type of the lighting devices in Embodiments 1 to 8 above may be applied to all the luminaires or plural types of the above-noted lighting devices may be mixed and applied to the plurality of luminaires. Further, when the lighting device in Embodiments 4 and 8 above is applied to a plurality of luminaires, plural sets of the step-down chopper circuit and the control circuit may be divided and received in individual luminaires or may be put together and received in a single luminaire.

Furthermore, in the lighting device according to the above embodiments, the step-down chopper circuit is used as an example of the DC/DC converter. The DC/DC converter according to the present invention, however, is not limited to the step-down chopper circuit in the above embodiments. The DC/DC converter may be any DC/DC converters as long as they have a switching element, an inductor, and a diode, and operates as described below. More specifically, any DC/DC convertors can be used in which a current flows through the inductor and energy is stored when the switching element is ON, and the energy stored in the inductor is discharged through the diode when the switching element is OFF.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting device that is connected to a DC power source to supply a current to a solid-state light-emitting element, the lighting device comprising:

a DC/DC converter; and a control circuit, wherein the DC/DC converter includes:

a switching element that is connected to the DC power source and is turned ON and OFF;

an inductor that is connected in series with the switching element, and through which the current from the DC power source flows when the switching element is ON;

a diode that supplies, to the solid-state light-emitting element, the current released from the inductor; and a current detection circuit that detects a current flowing through the switching element and outputs a detected current value that is a value of the current detected, the control circuit includes:

a drive circuit that turns the switching element ON and OFF;

a voltage detection circuit that detects either one of a voltage across the solid-state light-emitting element and a voltage across the inductor, and outputs a detected voltage value that is a value of the voltage detected; and a correction circuit that corrects a timing at which the drive circuit turns OFF the switching element, when the drive circuit detects that the inductor has finished releasing energy, the drive circuit turns ON the switching element, and when the detected current value reaches a predetermined current command value, the drive circuit turns OFF the switching element, and the correction circuit corrects the timing at which the drive circuit turns OFF the switching element, based on the detected voltage value.

2. The lighting device according to claim 1, wherein the correction circuit corrects the timing at which the drive circuit turns OFF the switching element, by correcting the predetermined current command value based on the detected voltage value.

3. The lighting device according to claim 2, wherein the correction circuit corrects the predetermined current command value such that, in a relationship between the detected voltage value and a peak value of the detected current value, the detected current value has peaks that are substantially the same in value at two or more different detected voltage values among a plurality of the detected voltage values.

4. The lighting device according to claim 2, wherein when the detected voltage value is less than or equal to a first threshold value, the correction circuit corrects the predetermined current command value to a first correction value that is less than the predetermined current command value.

5. The lighting device according to claim 4, wherein when the detected voltage value is less than or equal to a second threshold value that is less than the first threshold value, the correction circuit further corrects the predetermined current command value to a second correction value that is less than the first correction value.

6. The lighting device according to claim 5, wherein the first threshold value and the second threshold value fall between values of different forward voltages of two solid-state light-emitting elements among a plurality of the solid-state light-emitting elements to be connected to the lighting device.

7. The lighting device according to claim 4, wherein the correction circuit corrects the detected current value such that the detected current value after correction has a negative correlation with the detected voltage value.

8. The lighting device according to claim 2, wherein the correction circuit corrects the predetermined current command value such that a peak value of the current flowing through the inductor is constant regardless of the voltage detected by the voltage detection circuit.

9. The lighting device according to claim 2, wherein the correction circuit corrects the predetermined current command value such that the predetermined current command value after correction has a positive correlation with the detected voltage value.

10. The lighting device according to claim 1, wherein the correction circuit corrects the timing at which the drive circuit turns OFF the switching element, by correcting the detected current value based on the detected voltage value.

11. The lighting device according to claim 1, comprising a plurality of sets each including the DC/DC converter and the control circuit.

12. The lighting device according to claim 1, further comprising a dimming control circuit that changes the predetermined current command value.

13. A luminaire comprising:

the lighting device according to claim 1; and a solid-state light-emitting element.

* * * * *